US011677163B1

(12) United States Patent
Watson

(10) Patent No.: US 11,677,163 B1
(45) Date of Patent: Jun. 13, 2023

(54) QUASI-OMNI CYLINDRICAL ANTENNA WITH NULL-FILLING SUB ARRAYS

(71) Applicant: Communication Components Antenna Inc., Kanata (CA)

(72) Inventor: Paul Robert Watson, Kanata (CA)

(73) Assignee: Communication Components Antenna Inc., Ontario (CA)

( * ) Notice: Subject to any disclaimer, the term of this patent is extended or adjusted under 35 U.S.C. 154(b) by 0 days.

(21) Appl. No.: 17/668,861

(22) Filed: Feb. 10, 2022

(51) Int. Cl.
*H01Q 21/20* (2006.01)
*H01Q 5/28* (2015.01)

(52) U.S. Cl.
CPC ..... *H01Q 21/205* (2013.01); *H01Q 5/28* (2015.01)

(58) Field of Classification Search
CPC ..... H01Q 5/48; H01Q 5/28; H01Q 9/0407; H01Q 9/16; H01Q 9/285; H01Q 9/44; H01Q 19/108; H01Q 21/062; H01Q 21/205
See application file for complete search history.

(56) References Cited

U.S. PATENT DOCUMENTS 5,969,689 A * 10/1999 Martek ..... H01Q 1/42 343/758
10,505,609 B2 * 12/2019 Zimmerman ..... H01Q 3/2605
2004/0174303 A1 * 9/2004 Duxbury ..... H01Q 9/0407 343/700 MS
2013/0201070 A1 * 8/2013 Parsche ..... H01Q 13/0208 343/786
2014/0162655 A1 * 6/2014 Hong ..... H01Q 21/26 343/893
2019/0173162 A1 * 6/2019 Farzaneh ..... H01Q 21/062
2020/0287296 A1 * 9/2020 Kwak ..... H01Q 21/205
2020/0395674 A1 * 12/2020 Shen ..... H01Q 5/40
2021/0021019 A1 * 1/2021 Hou ..... H01Q 1/246

FOREIGN PATENT DOCUMENTS

EP 3208887 * 8/2017
JP H0832347 * 2/1996

* cited by examiner

*Primary Examiner* — Awat M Salih
(74) *Attorney, Agent, or Firm* — Sofer & Haroun, LLP

(57) ABSTRACT

An antenna producing a quasi-omni radiation pattern. The antenna includes at least three main panels, each having a plurality of radiating elements thereon, disposed in one or more columns of elements. The main panels are disposed in a substantially circular arrangement to generate the quasi-omni radiation pattern. At least one null filling panel is disposed between every two consecutive main panels of the at least three main panels, directed towards a null in the quasi-omni radiation pattern between the two consecutive main panels. The null filling panel has at least a single column of elements that radiate a null filling signal that is substantially the same signal as a signal from elements from the two adjacent main panels.

13 Claims, 35 Drawing Sheets

3 Facet Array:
View from Above

| Name | Theta | Ang | Mag |
|---|---|---|---|
| m1 | -62.5000 | -62.5000 | -18.9332 |

| Curve Info |
|---|
| PolA_dB<br>Setup 1 : Sweep<br>Freq='3.65GHz' Phi='90deg' |
| PolB_dB<br>Setup 1 : Sweep<br>Freq='3.65GHz' Phi='90deg' |

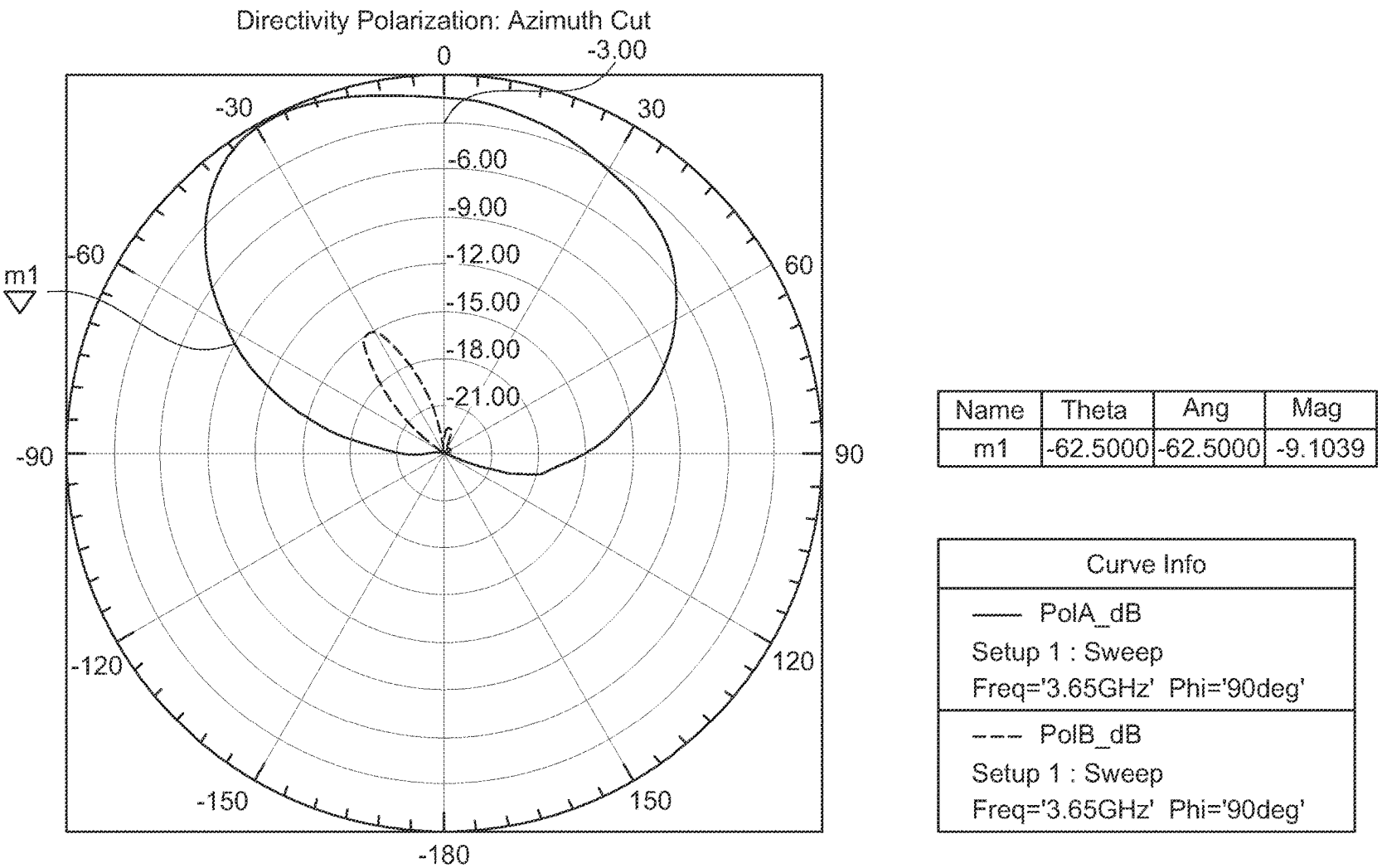
FIG. 3A1
(PRIOR ART)

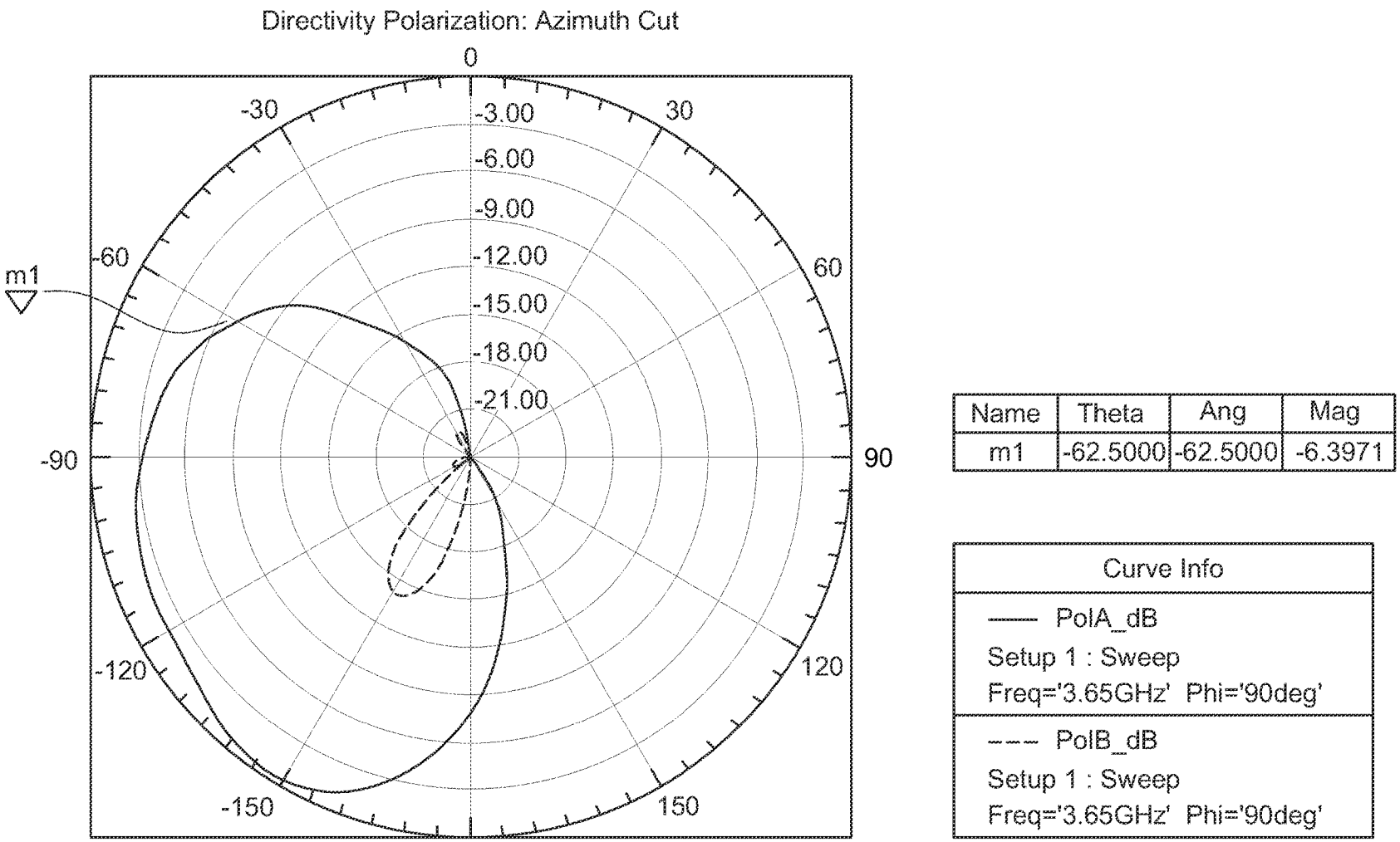
FIG. 3B1
(PRIOR ART)

| Name | Theta | Ang | Mag |
|---|---|---|---|
| m1 | -62.5000 | -62.5000 | -105.4367 |

| Curve Info |
|---|
| ang_deg_val(ImagPolA)<br>Setup 1 : Sweep<br>Freq='3.65GHz' Phi='90deg' |

FIG. 3C1
(PRIOR ART)

| Name | Theta | Ang | Mag |
|---|---|---|---|
| m1 | -62.5000 | -62.5000 | 68.0437 |

| Curve Info |
|---|
| ang_deg_val(ImagPolA)<br>Setup 1 : Sweep<br>Freq='3.65GHz' Phi='90deg' |

FIG. 3D1
(PRIOR ART)

HFSS Design1

| Curve Info |
| --- |
| PolA_dB<br>Setup 1 : Sweep<br>Freq='3.1GHz' Phi='90deg' |
| PolA_dB<br>Setup 1 : Sweep<br>Freq='3.2375GHz' Phi='90deg' |
| PolA_dB<br>Setup 1 : Sweep<br>Freq='3.375GHz' Phi='90deg' |
| PolA_dB<br>Setup 1 : Sweep<br>Freq='3.5125GHz' Phi='90deg' |
| PolA_dB<br>Setup 1 : Sweep<br>Freq='3.65GHz' Phi='90deg' |
| PolA_dB<br>Setup 1 : Sweep<br>Freq='3.7875GHz' Phi='90deg' |
| PolA_dB<br>Setup 1 : Sweep<br>Freq='3.925GHz' Phi='90deg' |
| PolA_dB<br>Setup 1 : Sweep<br>Freq='4.0625GHz' Phi='90deg' |
| PolA_dB<br>Setup 1 : Sweep<br>Freq='4.2GHz' Phi='90deg' |

FIG. 4B
(PRIOR ART)

HFSS Design1

| Curve Info |
| --- |
| PolA_dB<br>Setup 1 : Sweep<br>Freq='3.1GHz' Phi='90deg' |
| PolA_dB<br>Setup 1 : Sweep<br>Freq='3.2375GHz' Phi='90deg' |
| PolA_dB<br>Setup 1 : Sweep<br>Freq='3.375GHz' Phi='90deg' |
| PolA_dB<br>Setup 1 : Sweep<br>Freq='3.5125GHz' Phi='90deg' |
| PolA_dB<br>Setup 1 : Sweep<br>Freq='3.65GHz' Phi='90deg' |
| PolA_dB<br>Setup 1 : Sweep<br>Freq='3.7875GHz' Phi='90deg' |
| PolA_dB<br>Setup 1 : Sweep<br>Freq='3.925GHz' Phi='90deg' |
| PolA_dB<br>Setup 1 : Sweep<br>Freq='4.0625GHz' Phi='90deg' |
| PolA_dB<br>Setup 1 : Sweep<br>Freq='4.2GHz' Phi='90deg' |
| PolA_dB<br>Setup 1 : Sweep<br>Freq='3.1GHz' Phi='90deg' |

FIG. 5B
(PRIOR ART)

HFSS Design1

| Curve Info |
| --- |
| dB(Gain Total)<br>Setup 1 : Sweep<br>Freq='3.1GHz' Phi='90deg' |
| dB(Gain Total)<br>Setup 1 : Sweep<br>Freq='3.2375GHz' Phi='90deg' |
| dB(Gain Total)<br>Setup 1 : Sweep<br>Freq='3.375GHz' Phi='90deg' |
| dB(Gain Total)<br>Setup 1 : Sweep<br>Freq='3.5125GHz' Phi='90deg' |
| dB(Gain Total)<br>Setup 1 : Sweep<br>Freq='3.65GHz' Phi='90deg' |
| dB(Gain Total)<br>Setup 1 : Sweep<br>Freq='3.7875GHz' Phi='90deg' |
| dB(Gain Total)<br>Setup 1 : Sweep<br>Freq='3.925GHz' Phi='90deg' |
| dB(Gain Total)<br>Setup 1 : Sweep<br>Freq='4.0625GHz' Phi='90deg' |
| dB(Gain Total)<br>Setup 1 : Sweep<br>Freq='4.2GHz' Phi='90deg' |

FIG. 6B
(PRIOR ART)

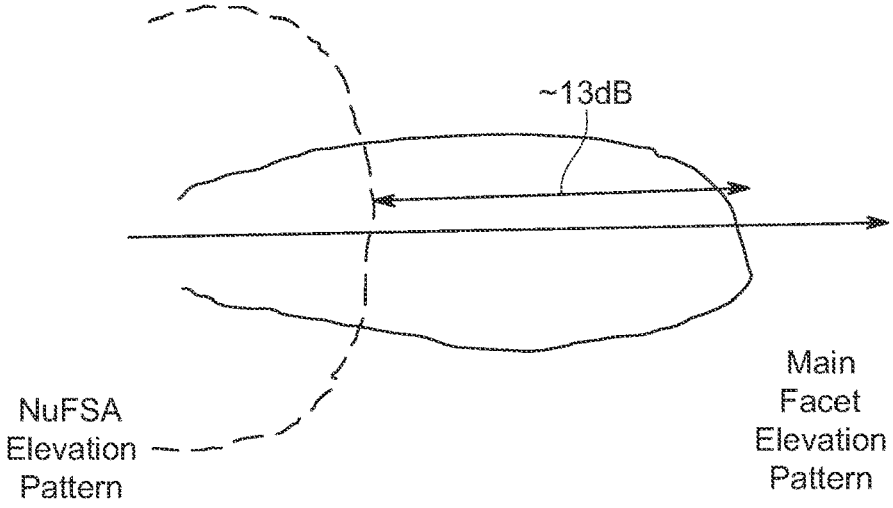
FIG. 11
| NuFSA / Polarity / Main Facet | Config 1a | Config 1b | Config 2a | Config 2b | |
|---|---|---|---|---|---|
| +45° | +45° | -45° | RHCP | LHCP | |
| -45° | -45° | +45° | LHCP | RHCP | |
NuFSA Element Polarizations
FIG. 12A
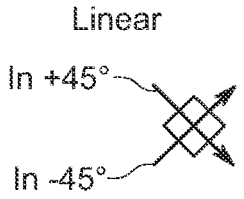
FIG. 12B
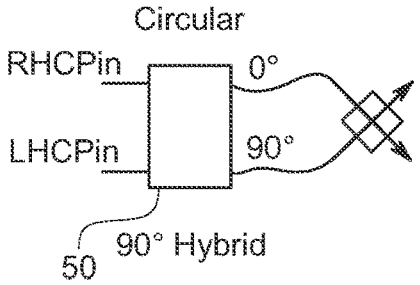
FIG. 12C HFSS Design1

| Curve Info |
| --- |
| ——— dB(Gain Total)<br>Setup 1 : Sweep<br>Freq='3.1GHz' Phi='90deg' |
| – – – – dB(Gain Total)<br>Setup 1 : Sweep<br>Freq='3.2375GHz' Phi='90deg' |
| —·—·— dB(Gain Total)<br>Setup 1 : Sweep<br>Freq='3.375GHz' Phi='90deg' |
| —·— dB(Gain Total)<br>Setup 1 : Sweep<br>Freq='3.5125GHz' Phi='90deg' |
| ····· dB(Gain Total)<br>Setup 1 : Sweep<br>Freq='3.65GHz' Phi='90deg' |
| —··— dB(Gain Total)<br>Setup 1 : Sweep<br>Freq='3.7875GHz' Phi='90deg' |
| —·-·— dB(Gain Total)<br>Setup 1 : Sweep<br>Freq='3.925GHz' Phi='90deg' |
| —···— dB(Gain Total)<br>Setup 1 : Sweep<br>Freq='4.0625GHz' Phi='90deg' |
| -·-·-·- dB(Gain Total)<br>Setup 1 : Sweep<br>Freq='4.2GHz' Phi='90deg' |

FIG. 13B

HFSS Design1

| Curve Info |
| --- |
| ——— PolA_dB<br>Setup 1 : Sweep<br>Freq='3.1GHz' Phi='90deg' |
| – – – – PolA_dB<br>Setup 1 : Sweep<br>Freq='3.2375GHz' Phi='90deg' |
| —·—·— PolA_dB<br>Setup 1 : Sweep<br>Freq='3.375GHz' Phi='90deg' |
| —-— PolA_dB<br>Setup 1 : Sweep<br>Freq='3.5125GHz' Phi='90deg' |
| ····· PolA_dB<br>Setup 1 : Sweep<br>Freq='3.65GHz' Phi='90deg' |
| —··— PolA_dB<br>Setup 1 : Sweep<br>Freq='3.7875GHz' Phi='90deg' |
| —-- — PolA_dB<br>Setup 1 : Sweep<br>Freq='3.925GHz' Phi='90deg' |
| —···— PolA_dB<br>Setup 1 : Sweep<br>Freq='4.0625GHz' Phi='90deg' |
| --·--·- PolA_dB<br>Setup 1 : Sweep<br>Freq='4.2GHz' Phi='90deg' |
| ——— PolA_dB<br>Setup 1 : Sweep |

FIG. 14B

HFSS Design1

| Curve Info |
| --- |
| ——— dB(Gain Total)<br>Setup 1 : Sweep<br>Freq='3.1GHz' Phi='90deg' |
| – – – – dB(Gain Total)<br>Setup 1 : Sweep<br>Freq='3.2375GHz' Phi='90deg' |
| —·—·— dB(Gain Total)<br>Setup 1 : Sweep<br>Freq='3.375GHz' Phi='90deg' |
| —-— dB(Gain Total)<br>Setup 1 : Sweep<br>Freq='3.5125GHz' Phi='90deg' |
| ····· dB(Gain Total)<br>Setup 1 : Sweep<br>Freq='3.65GHz' Phi='90deg' |
| —··— dB(Gain Total)<br>Setup 1 : Sweep<br>Freq='3.7875GHz' Phi='90deg' |
| —-·— dB(Gain Total)<br>Setup 1 : Sweep<br>Freq='3.925GHz' Phi='90deg' |
| —···— dB(Gain Total)<br>Setup 1 : Sweep<br>Freq='4.0625GHz' Phi='90deg' |
| -·-·-·- dB(Gain Total)<br>Setup 1 : Sweep<br>Freq='4.2GHz' Phi='90deg' |

FIG. 15B

HFSS Design1

| Curve Info |
| --- |
| ——— PolA_dB<br>Setup 1 : Sweep<br>Freq='3.1GHz' Phi='90deg' |
| - - - - PolA_dB<br>Setup 1 : Sweep<br>Freq='3.2375GHz' Phi='90deg' |
| —·—·— PolA_dB<br>Setup 1 : Sweep<br>Freq='3.375GHz' Phi='90deg' |
| —--— PolA_dB<br>Setup 1 : Sweep<br>Freq='3.5125GHz' Phi='90deg' |
| ····· PolA_dB<br>Setup 1 : Sweep<br>Freq='3.65GHz' Phi='90deg' |
| —··— PolA_dB<br>Setup 1 : Sweep<br>Freq='3.7875GHz' Phi='90deg' |
| —-·-— PolA_dB<br>Setup 1 : Sweep<br>Freq='3.925GHz' Phi='90deg' |
| —···— PolA_dB<br>Setup 1 : Sweep<br>Freq='4.0625GHz' Phi='90deg' |
| -·-·-·- PolA_dB<br>Setup 1 : Sweep<br>Freq='4.2GHz' Phi='90deg' |
| ——— PolA_dB<br>Setup 1 : Sweep |

FIG. 16B

| Curve Info |
| --- |
| ——— dB(Gain Total)<br>Setup 1 : Sweep<br>Freq='3.1GHz' Phi='90deg' |
| – – – – dB(Gain Total)<br>Setup 1 : Sweep<br>Freq='3.2375GHz' Phi='90deg' |
| —·—·— dB(Gain Total)<br>Setup 1 : Sweep<br>Freq='3.375GHz' Phi='90deg' |
| —·· — dB(Gain Total)<br>Setup 1 : Sweep<br>Freq='3.5125GHz' Phi='90deg' |
| ····· dB(Gain Total)<br>Setup 1 : Sweep<br>Freq='3.65GHz' Phi='90deg' |
| —··— dB(Gain Total)<br>Setup 1 : Sweep<br>Freq='3.7875GHz' Phi='90deg' |
| —·· — dB(Gain Total)<br>Setup 1 : Sweep<br>Freq='3.925GHz' Phi='90deg' |
| —···— dB(Gain Total)<br>Setup 1 : Sweep<br>Freq='4.0625GHz' Phi='90deg' |
| ——— dB(Gain Total)<br>Setup 1 : Sweep |

FIG. 17B

HFSS Design1

| Curve Info |
| --- |
| ——— PolA_dB<br>Setup 1 : Sweep<br>Freq='3.1GHz' Phi='90deg' |
| – – – – PolA_dB<br>Setup 1 : Sweep<br>Freq='3.2375GHz' Phi='90deg' |
| —·—·— PolA_dB<br>Setup 1 : Sweep<br>Freq='3.375GHz' Phi='90deg' |
| —-— PolA_dB<br>Setup 1 : Sweep<br>Freq='3.5125GHz' Phi='90deg' |
| ····· PolA_dB<br>Setup 1 : Sweep<br>Freq='3.65GHz' Phi='90deg' |
| —··— PolA_dB<br>Setup 1 : Sweep<br>Freq='3.7875GHz' Phi='90deg' |
| —-·-— PolA_dB<br>Setup 1 : Sweep<br>Freq='3.925GHz' Phi='90deg' |
| —···— PolA_dB<br>Setup 1 : Sweep<br>Freq='4.0625GHz' Phi='90deg' |
| --·--·- PolA_dB<br>Setup 1 : Sweep<br>Freq='4.2GHz' Phi='90deg' |
| ——— PolA_dB<br>Setup 1 : Sweep |

FIG. 18B

QUASI-OMNI CYLINDRICAL ANTENNA WITH NULL-FILLING SUB ARRAYS

FIELD OF THE INVENTION

The present arrangement relates to a quasi-omni cellular antenna. More particularly, the present arrangement relates to a quasi-omni cellular antenna that includes additional panels for reducing nulls in the radiation pattern.

DESCRIPTION OF RELATED ART

An omni directional, or more specifically a quasi omni-directional, cellular antenna is a cellular antenna that attempts to provide cellular coverage in an essentially circular pattern around the antenna as measured in the azimuth plane. One prior art approach to an omni-directional array is to sequentially arrange similar planar arrays around a central axis of rotation, in steps of rotational angles such as 60°, 90°, or 120° degrees, resulting in 6, 4, or 3 facets, respectively.

This approach can create a substantially cylindrical array and uses antenna elements with radiation patterns of 60° to 90° degrees, which can be fed with a common input signal, resulting in a Quasi-Omni radiation pattern. The array is typically oriented, so the central axis of rotation is pointed vertically 'up', so the Quasi-Omni radiation pattern is generated in an azimuth pattern.

The term quasi-omni qualitatively refers to the non-constant gain around the full 360° of the azimuth pattern, as opposed to the constant gain that is generated by a vertically oriented dipole, for example. This gain variation creates undesirable peaks and nulls in the azimuth pattern, including deep nulls which can cause sub-optimal coverage issues.

One prior art method to reduce the azimuth nulls is to increase the number of facets or panels; however, this only really works for quasi-omni arrays which have one column of antenna elements on each facet. For example, in the case of increased port counts (ie: higher than 2 omni-directional ports), when arrays with multiple columns of elements on each facet are used to form quasi-omni arrays, the relatively large electrical distance between radiating columns can still cause the deep nulls and coverage issues.

Another issue with increased facet count is that the cylindrical radius must increase to accommodate the planar arrays, increasing the total volume of the quasi-omni array. This is particularly an issue with the increased port count implementations.

FIG. 1 shows an azimuth pattern of a prior art quasi-omni antenna with four facets, exhibiting excess nulls in the pattern. There are at least two fundamental issues with the multi-facet implementation of an omni directional array: creation of pattern nulls, and loss of polarization purity near the nulls. Polarization purity refers to a figure of merit known as cross polarization discrimination which is equal to the ratio of the co-polar component of the intended (desired) polarization compared to the unintended orthogonal (unwanted) cross-polar component (referring to the radiated field strengths).

Both of these issues occur near the mid-point angle between adjacent facets (see FIG. 1 arrows). FIG. 1 illustrates the azimuth pattern directivity plot for a four-facet quasi-omni directional array, showing the undesirable null effect. The deep nulls can cause coverage issues for users located in the nulls.

The nulls in the prior art multi-facet omni arrays are generally caused by the low gain regions of the facet element patterns; however, even deeper nulls can also be caused by field cancellation due to anti-phase (180° offset) super positioning of similar magnitude signals from two sources from adjacent facets. In this case, the signals from elements on adjacent facets null each other.

The anti-phase super positioning occurs near the mid-point angle between adjacent facets. The phase delta (defined as the difference in the phase of the radiated field from each of the two sources (facets) is caused by the propagation delay difference between adjacent facet elements. This delay increases with the increased numbers of ports that have multiple columns of elements on each facet. Additionally, reflector discontinuity effects and the parasitic effects of adjacent elements on the same reflector also can affect propagation phase (defined as the phase of a radiated field arriving at a specific location in the antennas coverage area).

FIGS. 2A-2C show another prior art three facet antenna and its azimuth pattern, also exhibiting deep nulls corresponding to angles near to the intersections of the three facets. The prior art three facet antenna is shown here to illustrate the same null effect occurs on all quasi omni antennas regardless of the number of facets. As seen in FIG. 2B, which is a composite pattern for all elements in a common column on the facets at a single specific frequency, the nulls exhibited are similar to those in prior art FIG. 1. The table in FIG. 2C identifies the frequency as well as a point M1 as well as the Theta, Ang, and Mag referring to the magnitude of the radiated field strength and specifically to the co-pole (desired) polarization component at a specific azimuth angle (i.e. Theta, Ang . . . which can be the same).

FIGS. 3A-3B (and FIGS. 3A1 and 3B1) show breakdowns of the pattern from FIG. 2B where the azimuth pattern is generated by a single excited column of elements at one frequency (e.g. approximately 3.6 GHz) on two different facets with roughly equal amplitudes at point (m1). The facets "A" and "B" from FIGS. 3A and 3B from FIG. 2B emit the corresponding signals. This point (m1) identified in FIG. 3A1 and FIG. 3B1 shows the location and depth of the null created in part by the equal amplitude of signals at that point at 180° phase delta (as identified by marker m1, FIG. 2*c*).

FIGS. 3C and 3D (and FIGS. 3C1 and 3D1), are the related electrical field phases for the same excited facets/columns "A" and "B" from FIGS. 3A and 3B respectively. FIGS. 3C1 and FIGS. 3D1 identify the same frequency and angle Theta of the pattern (as used in 2B, 2C, 3A1, 3B1 figures) in the marker point m1 on the plot illustrating the phase of the radiated field from each of the two facet columns. Note that this phase is marked at 'Mag' in the plots 3D1 and 3C1, and the relative phase difference is approaching 180 degrees.

FIG. 4A is another prior art image of an azimuth pattern from the same three facet quasi-omni antenna discussed in reference with FIGS. 2-3, but this time showing each of the various frequencies from a common excited column on each of the facets (co-pole only—cross pole removed for clarity of image). Co-pole and cross-pole are as defined previously (desired and undesired radiated field polarizations, respectively). As shown in FIG. 4B, the different frequencies and columns each exhibit a slightly different dB level for the null, but never-the-less each frequency has a null at substantially the same location.

Prior art FIG. 5A is the same azimuth plot as FIG. 4, but with the cross-pole included. As shown in FIG. 5A and the related table FIG. 5B near the pattern nulls, but across a fairly wide-angle range, cross-pole radiation content increases and even rises above the radiated co-pole content, meaning that at the nulls there is no polarization purity, further degrading the signal quality at those nulls.

FIG. 6A is yet again the same azimuth pattern for the three-facet prior art quasi-omni antenna with total field strength gain plotted in dB (meaning that the total radiated field strength is divided by input power (which gives gain)) is plotted, so both co and cross polarity field contents are present. As seen in FIG. 6A and the related table in FIG. 6B the nulls in the total gain azimuth pattern are still present.

Combined, FIGS. 2A—FIG. 6B illustrate the issue of nulls and lack of polarisolation/purity for an exemplary prior art three-facet quasi omni antenna.

Objects and Summary

The present arrangement overcomes the drawbacks associated with the prior art and provides a Quasi-Omni Array with Null-Filling Helper Sub-Arrays (NuFSA) that 'fills-in' the deep null depths that are typically generated by multi-facet Omni-Directional array implementations, especially in cases of increased port count implementations (more than 2 ports), resulting in better coverage around the 360° azimuth plane.

The present NuFSA Quasi-Omni Array implementation requires a smaller radius (reduced volume), especially compared to four or six facet implementations with increased port counts (multiple element columns on each facet).

In one embodiment, the present NuFSA Quasi-Omni Array may be based on three conventional facets, arranged at 120° degree increments, along with single column 'helper' linear arrays implemented on narrow facets at the mid-rotational point between the conventional facets (60° degrees offset).

Such a design for the NuFSA Quasi-Omni Array achieves an improved azimuth quasi-omni pattern coverage along with greater than 9 dB reduction in null depth, —at a reduced total array volume (compared to four and six facet implementations) with a more si simplified construction as well as reduced weight and cost, compared to four and six facet implementations.

To this end the present arrangement is an antenna for producing a quasi-omni radiation pattern. The antenna includes at least three main panels, each having a plurality of radiating elements thereon, disposed in one or more columns of elements. The main panels are disposed in a substantially circular arrangement to generate the quasi-omni radiation pattern. At least one null filling panel is disposed between every two consecutive main panels of the at least three main panels, directed towards a null in the quasi-omni radiation pattern between the two consecutive main panels. The null filling panel has at least a single column of elements that radiate a null filling signal that is substantially the same signal as a signal from elements from the two adjacent main panels.

BRIEF DESCRIPTION OF THE DRAWINGS

The present invention can be best understood through the following description and accompanying drawing, wherein:

FIGS. 3A, 3A1, 3B, 3B1, 3C, 3C1, 3D, and 3D1 illustrate a prior art three facet antenna and isolated azimuth patterns for two different single columns at one frequency, as well as the related electrical field phase plot for the patterns;

FIGS. 4A and 4B show a prior art azimuth pattern and related frequency table from the same three facet quasi-omni antenna illustrated in FIGS. 3A-3B, but showing each of the various frequencies from a common excited column on each of the facets (co-pole only—cross pole removed);

FIGS. 5A and 5B show a prior art azimuth pattern, and related frequency table, from the same three facet quasi-omni antenna, but showing each of the various frequencies from a common excited column on each of the facets (cross pole included);

FIGS. 6A and 6B show the same prior art azimuth pattern, and related frequency table, from FIGS. 4A and 5A for the three-facet prior art quasi-omni antenna with co-pole and cross-pole plots combined (total field gain dB);

FIG. 11 shows an elevation view of the pattern of FIG. 10, comparing the patterns from main facet elements relative to the patterns from the null-filling element, in accordance with one embodiment;

FIG. 12A is a chart of different polarization configurations for the exemplary NuFSA antenna for a three main facet quasi omni antenna and FIGS. 12B and 12C show related diagrams for antenna element polarizations, in accordance with one embodiment;

FIGS. 13A and 13*b* illustrate a comparison of a total field gain of a prior art antenna from prior art FIGS. 6A and 6B vs the total field gain of the exemplary NuFSA antenna for a three main facet quasi omni antenna, in a first polarization configuration, in accordance with one embodiment;

FIGS. 14A and 14B illustrate a comparison of an azimuth co and cross pole plot of a prior art antenna from prior art FIGS. 5A and 5B vs that of the exemplary NuFSA antenna for a three main facet quasi omni antenna, in a first polarization configuration, in accordance with one embodiment;

FIGS. 15A and 15B illustrate a comparison of a total field gain of a prior art antenna from prior art FIGS. 6A and 6B vs the total field gain of the exemplary NuFSA antenna for a three main facet quasi omni antenna, in a second polarization configuration, in accordance with one embodiment;

FIGS. 16A and 16B illustrate a comparison of an azimuth co and cross pole plot of a prior art antenna from prior art FIGS. 5A and 5B vs that of the exemplary NuFSA antenna for a three main facet quasi omni antenna, in a second polarization configuration, in accordance with one embodiment;

FIGS. 17A and 17B illustrate a comparison of a total field gain of a prior art antenna from prior art FIGS. 6A and 6B vs the total field gain of the exemplary NuFSA antenna for a three main facet quasi omni antenna, in a third polarization configuration, in accordance with one embodiment; and FIGS. 18A and 18B illustrate a comparison of an azimuth co and cross polarity plot of a prior art antenna from prior art FIGS. 5A and 5B vs the total field gain of the exemplary NuFSA antenna for a three main facet quasi omni antenna, in a third polarization configuration, in accordance with one embodiment.

DETAILED DESCRIPTION

Figure 7A:
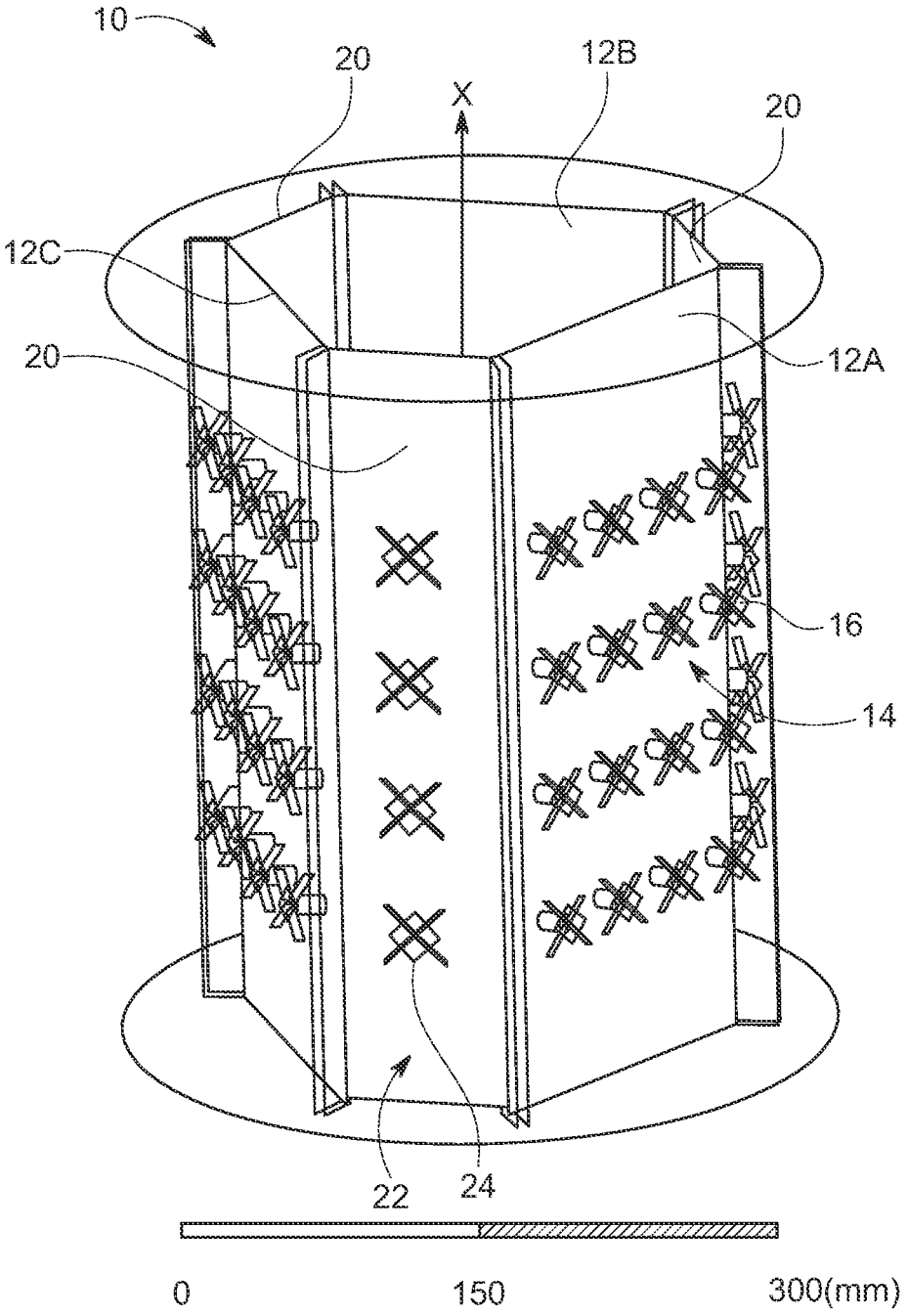
FIGS. 7A and 7B illustrate an exemplary NuFSA antenna for a three main facet quasi omni antenna, in accordance with one embodiment.
Figure 7B:
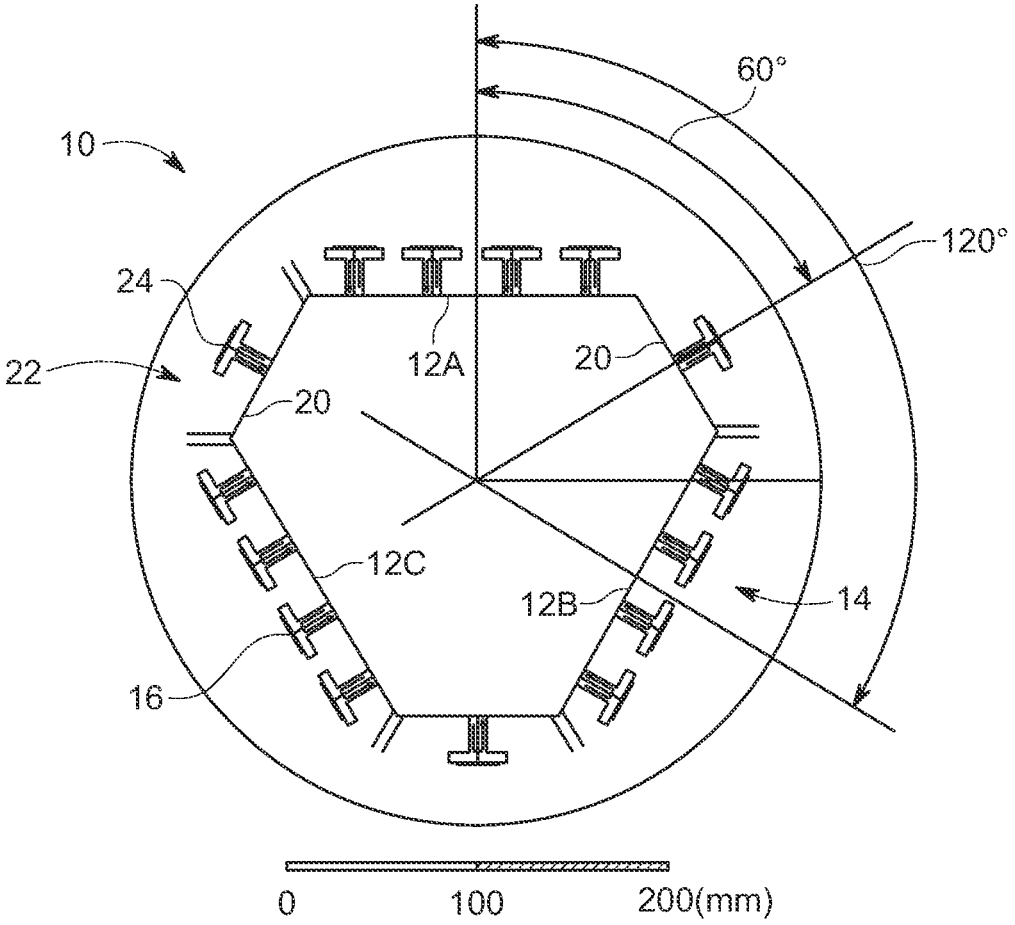

In accordance with one embodiment, FIGS. 7A and 7B show an exemplary NuFSA quasi omni antenna 10. This exemplary embodiment has three main facets 12A-12C, each of which have a plurality of columns 14 of antenna elements 16. It is understood that a similar design can be modified to use four main facet antennas, or six main facet antennas etc. . . . , but for the purposes of illustration, antenna 10 is shown having three main facets 12A-12C. Likewise, each main facet 12A-12C is shown with four columns 14 of elements 16 but other numbers of columns may be used as well. Additionally, antenna 10 is shown with dipole elements 16, but the same concept may be employed with patch elements or other such antenna radiating elements depending on the antenna design.

As shown in FIGS. 7A and 7B, antenna 10 also maintains three null-filling sub panels 20, each with one column 22 of null filling elements 24. As explained in more detail below, generally, there is one null filling element 24 for each column 14 on a main panel 12. Null-filling sub panels 20 are positioned at the apex/intersections of the three main panels 12 at the mid-point angle between adjacent main facets, in the case 60° offset (on each side totaling 120° to the next main panel 12). Additional null filling columns 22 may be placed on null-filling panels 20 if space permits and the need arises, but for the purposes of illustration one column 22 is shown in the figures and descried in the examples below.

Regarding the feeding of elements 16 on main facets 12 and null filling elements 24 on null filling facets 20 and as further illustrated in FIG. 8A, each column 14 of four elements 16 on the main facets 12 have a single element 24 in an adjacent null filling facet 20, fed with the same input signal. In this arrangement, main elements 16 and null-filling elements 24 are excited to +45° and −45° polarization as shown with the arrows (from two ports per column, one at +45° and one at −45° for a total of eight feeding ports per main facet 12—with elements 24 being fed from split signals from the same eight ports as explained below with respect to FIG. 9). This results in a 4:1 ratio of main facet elements 16 to null-filling elements 24 in this four-column 14 main facet 12 design, with the null filling elements 24 in a single column 22 of four elements (i.e. same number as the columns 14 on main facet 12). It is understood that ratios other than 4:1 may be chosen, depending on how many columns of elements 14 is implemented on each main facet, or whether more than one null filling column 22 is acceptable (e.g. based on physical space requirements or based on other signal strength parameters).

It is noted that the arrangement of FIG. 8A having four columns 14 of four elements 16 on each main panel 12 and a corresponding four NuFSA elements 24 is intended only as exemplary and is used throughout the application for the basis of an example. However, other alternative implementations may be used.

For example, the gain of antenna array 10 can be increased by increasing the length of main facet columns 14. The vertical size of NuFSA array 20 would increase along with main facet 12, although this is only done when it does not increase the NuFSA column length longer than the length of the main facet array. For example FIG. 8B shows a scenario with eight elements 16 in each main column 14, with eight NuFSA elements 24 on NuFSA facet 20, with two associated NuFSA elements 24, per column 14. Here in FIG. 8B the length of the main facets 12 is extended along with NuFSA panel 20 to improve overall gain (in situations where vertical length is not a particularly limiting factor).

Figure 8:
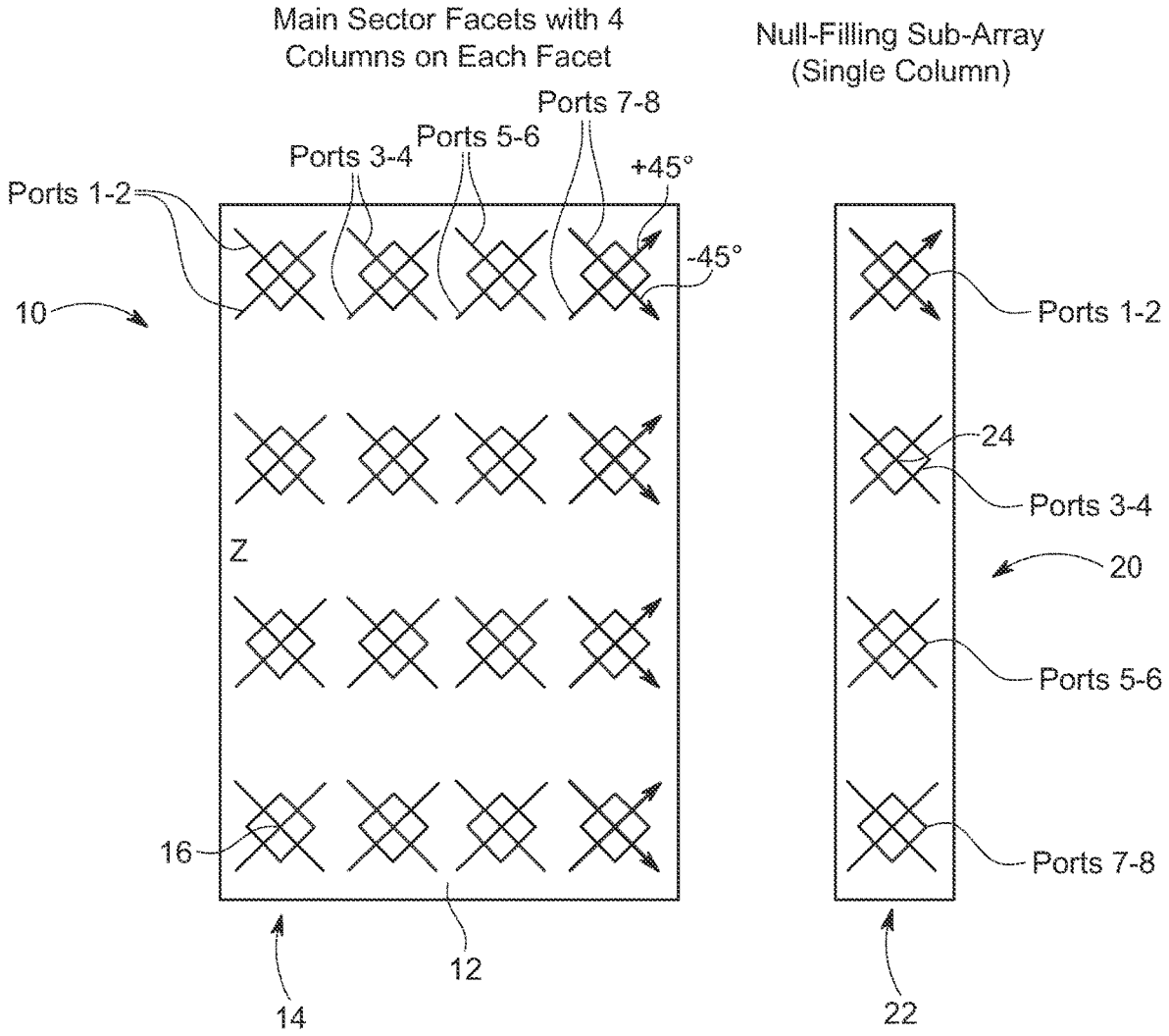
FIG. 8 illustrates a partial element arrangement for the exemplary NuFSA antenna for a three main facet quasi omni antenna of FIGS. 7A/7B, in accordance with one embodiment.
Figure 8B:
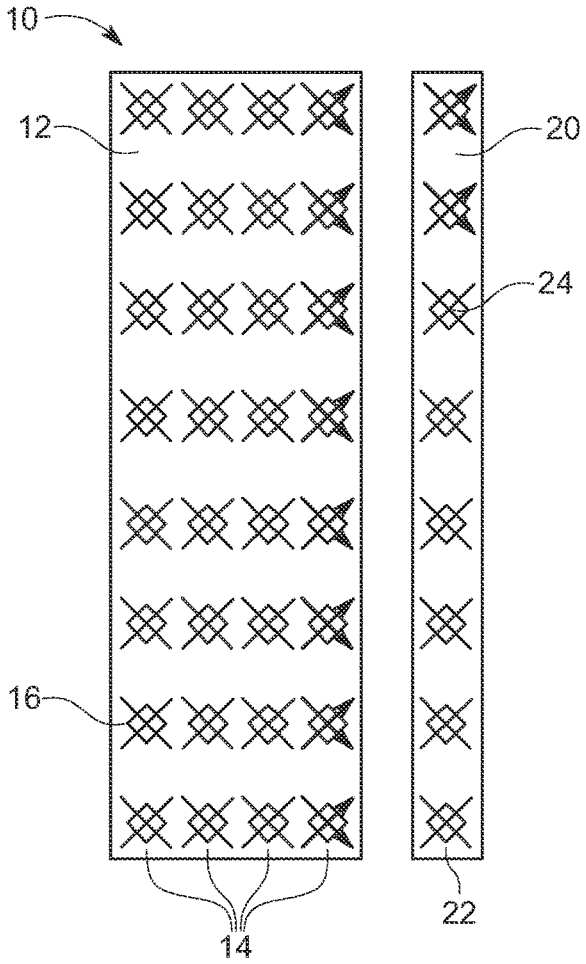
FIGS. 8B-8E illustrates a partial element arrangement for the exemplary NuFSA antenna for alternative versions of facet configurations of a main panel on a quasi omni antenna of FIGS. 7A/7B, in accordance with one embodiment.
Figure 8C:
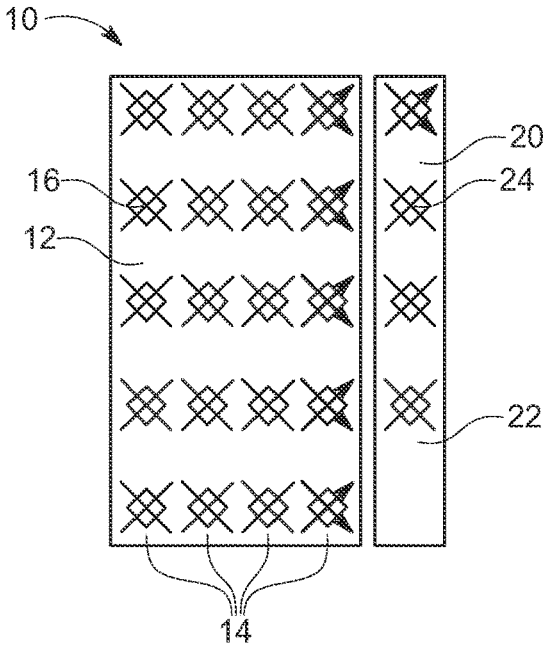

FIG. 8C, shows another example where each of main columns 14 have five elements 16, but keeping only four NuFSA elements 24 (one per column 14). This arrangement could be used for a little extra main facet gain, but where length restrictions prevent increasing NuFSA facet 20 to have two elements 24 per main facet column.

As another example not illustrated, if main facet column 14 had sixteen elements, then the NuFSA array would be 4 elements for each column, resulting in a NuFSA single column of sixteen elements.

This scaling approach allows for gain adjustment and maintains the null filling function. Also, such alternative approaches help the elevation beam width of NuFSA facet 20 to track the elevation beam width of main facet 12.

Depending on the number of input ports required for a particular antenna 10, the number of columns 14 on main facets 12 may be something other than four. This impacts the number of elements 24 in NuFSA column 22 and the scaling of the length of main facet column 14.

Figure 8D:
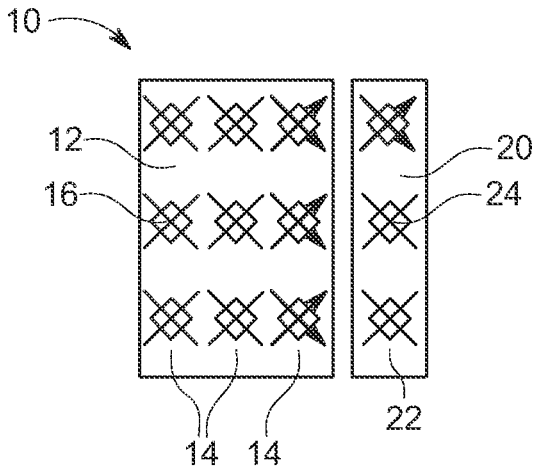

See for example FIG. 8D, which shows a main facet 12 with three columns 14 with three elements 16 each, and a NuFSA facet 20 with three elements 24. See also FIG. 8E, which shows a main facet 12 with five columns 14 with five elements 16 each, and a NuFSA facet 20 with five elements 24.

Figure 8E:
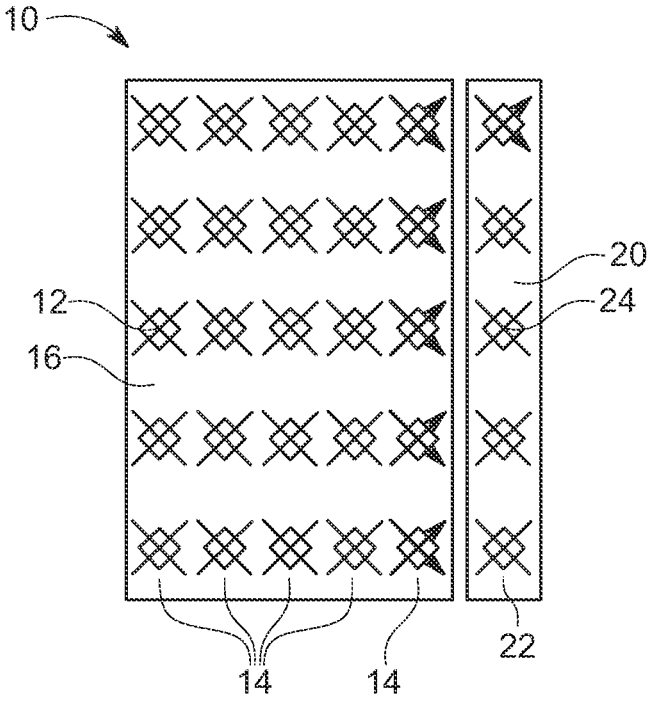

As shown in FIGS. 8D and 8E, NuFSA column 22 (the column to the right in each image), has the same number of elements 24 as columns 14 on main facet 12. Such an approach, as with FIGS. 8B and 8C may be used for scaling of signal gain.

Figure 9:
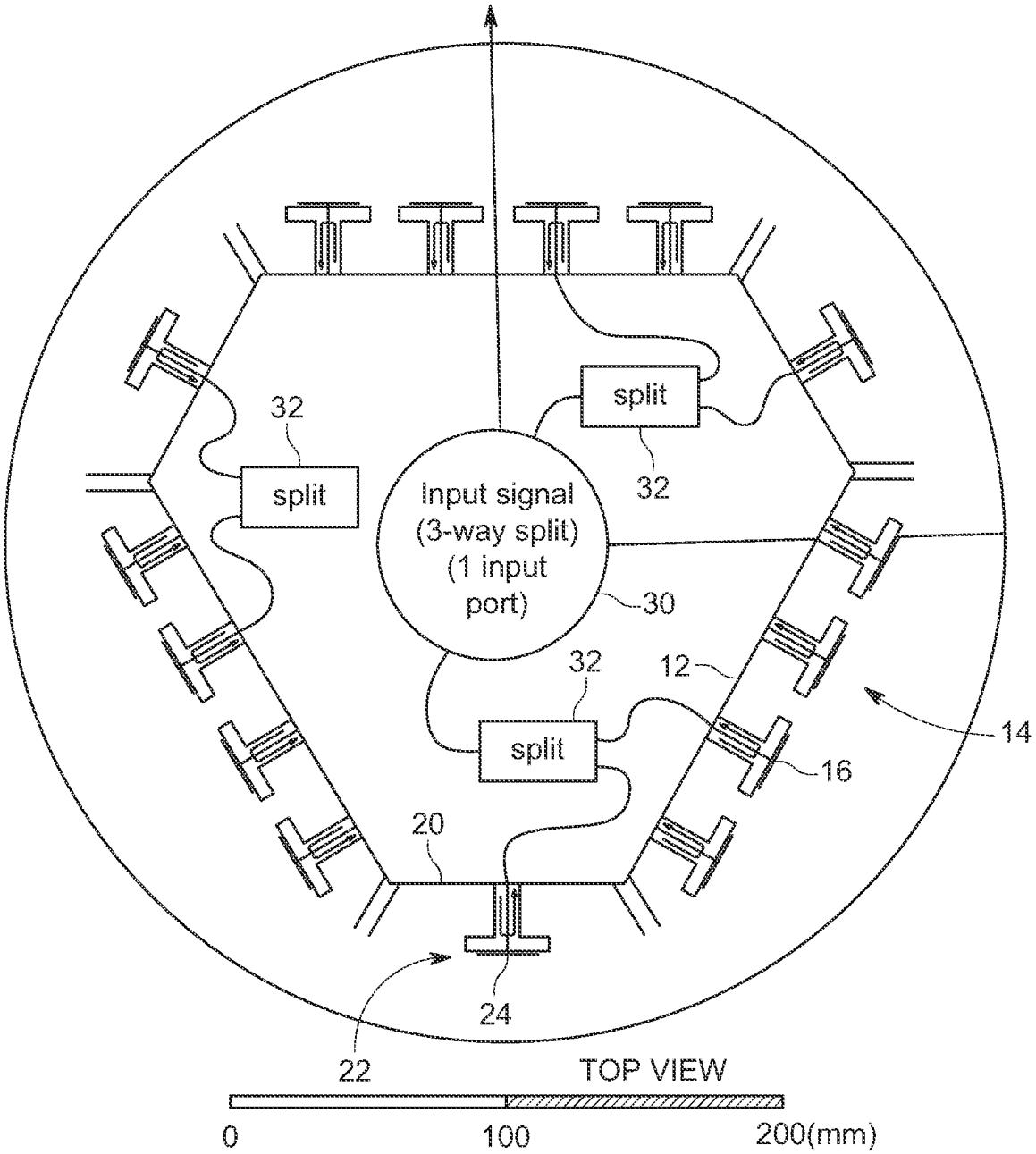
FIG. 9 illustrates a partial element feeding arrangement for the exemplary NuFSA antenna for a three main facet quasi omni antenna of FIGS. 7A/7B, in accordance with one embodiment.

FIG. 9 shows an exemplary port feeding arrangement for antenna 10 from FIGS. 7A, 7B, and 8. In FIG. 9, a single exemplary port 30 is shown (at the bottom of antenna 10. A feed signal is passed up to one column 14 of elements 16 on facet 12. Before reaching elements 16 in column 14, a splitter 32 is provided passing a portion of the signal to one null-filling element 24 on null-filling facet 20.

The three splitters 32 may be fed with equal portions (in terms of signal strength) of the input signal. The splitters 32 shown feed the main facet columns 14 with the majority of the split input power, with the null-filling element 24 getting on the order of −13 dB to −17 dB relative signal portion (i.e. about 1/20-1/40 of the power to main facet column 14). It is understood that copies of splitter 32 may be used, one for each main facet 12 column 14 of four main elements 16. FIG. 9 does not show any elevation beam forming network (splitter). All of 30 and 32 splitters shown in FIG. 9 are for the facets/arrays 12 and NufSA arrays 20 and effect azimuth pattern. A separate elevation beam former (not shown) would divide the main facet signal from splitter 32 to feed all four of elements 16 in vertical column 14. In one example a specific power split division ratio can be set as a design parameter, and once set, the power split ratio is fixed. This power split ratio can make the null depth less or more, and is chosen as a trade-off between fixing the null depth and effect on overall pattern gain, or even the creation of other nulls, although they are less of an issue (not as deep).

The phase of the null-filling element 24 excitation, relative to main facet column 14 can also varied which can have an effect on the null depths.

For example, it is noted that null-filling radiation from element 24 is equally susceptible to anti-phase nulling from the main facet 12 radiation, so the objective is to avoid this phasing by setting the distribution network transmission phase. The main facet column 14 feed signal from splitter 32 is also distributed in a vertical feed network (not shown). A vertical feed network splits input power and outputs it to elements 16 within main facet column 14 (in the vertical dimension). This effects the radiated pattern in the vertical plane (the elevation pattern). A horizontal feed network is shown in FIG. 9 below and it distributes power among main facet elements 16 and NuFSA array elements 24. This effects the radiated pattern in the azimuth plane (horizontal plane). That's the plane where the null filling occurs.

FIG. 10A shows a small portion of an azimuth pattern for a single sample frequency (3.65 GHz) for antenna 10, showing the overlap of the main pattern from elements 16 in a column 14 from a main facet 12, relative to the pattern from the adjacent null filing element 24 on the null filling facet 20. FIG. 10B is table illustrating the pattern characteristics. As shown in FIG. 10A the pattern from element 24 would help to "fill-in" nulls between the radiation patterns from elements 16 on main facets 16. The pattern from element 24 has less gain in the elevation plane (−6 dB) in this 4-column configuration because of the vertical ratio of 4:1 between main face and NuFSA arrays. Assuming an excitation of element 24 of 7 dB less than elements 16 on main facet 12, the radiated pattern from element 24 is 13 dB down from the total pattern peak.

Figure 10:
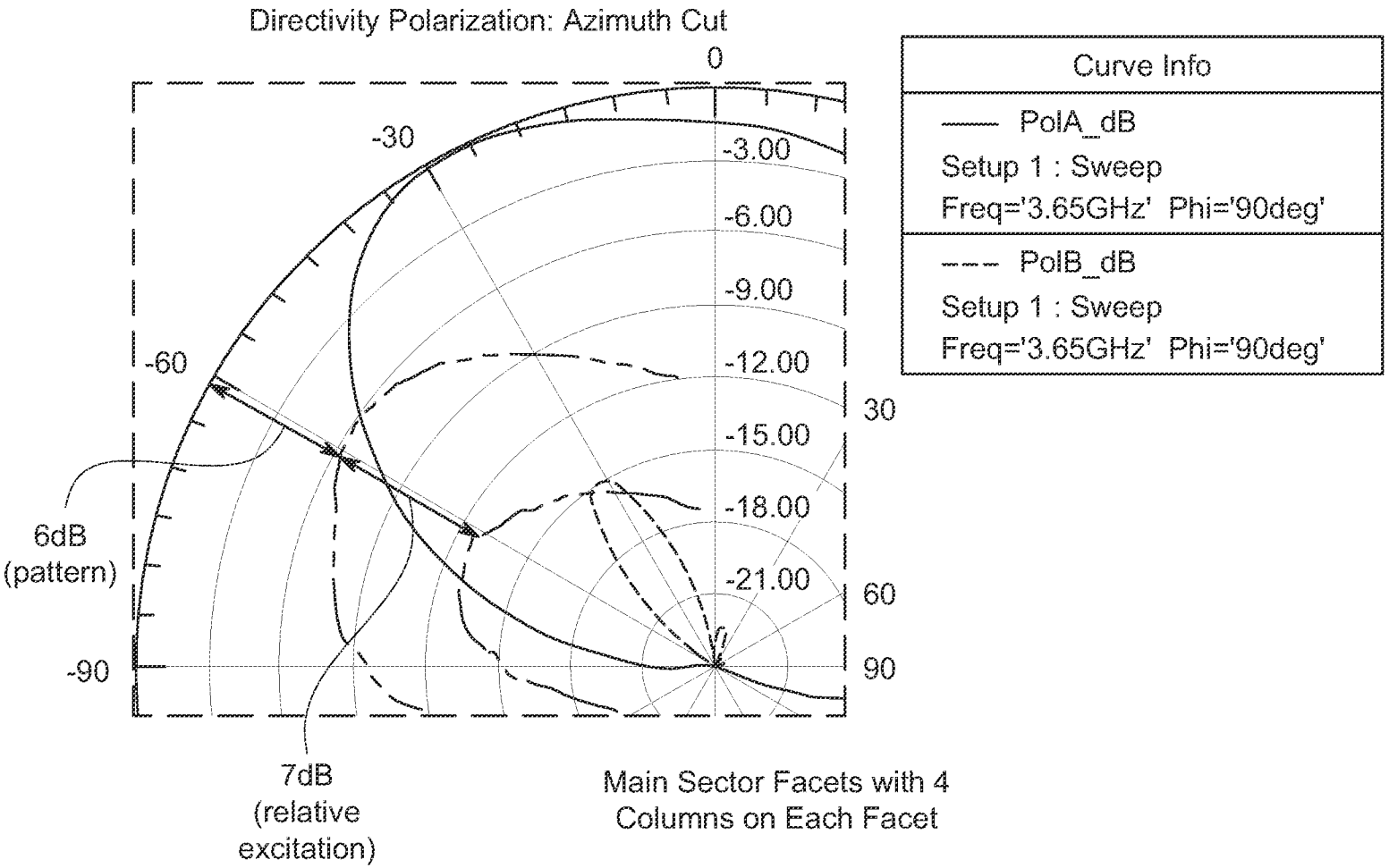
FIG. 10 illustrates a partial azimuth pattern for a single frequency of the NuFSA antenna showing the overlap of the main facet column pattern with the pattern from the adjacent null filling element, in accordance with one embodiment.

Applicants note that all of the plots in the application are co-pole radiation patterns (azimuth cuts for all). The properly-drawn line is the pattern from a main facet column. In FIG. 10 the arcing hand-drawn pattern at the 6 dB marking is the pattern from a single NuFSA element 24. It is down by 6 dB because of the vertical ratio of elements between main facet 4-elements 16 in column 14 compared to the single NuFSA element 24. 6 dB is a result of the 4:1 ratio. The arcing hand drawn pattern at the 6+7 dB point is just the same pattern from the NuFSA element 24, except the extra 7 dB coming from power splitter 32 having about that split ratio between main facet column 14 and NuFSA element 24. When one adds the total field strength difference due to the reduced relative NuFSA element 24 gain and the lower feed power to begin with, it ends up down about 13 dB (6+7).

FIG. 11 shows a different view of comparing the patterns from main facet elements 16 relative to the patterns from the null-filling element 24. As shown in FIG. 11, the pattern from null-filling element 24 may be approximately four times wider than the elevation beam from the main facet elements 16, and based on the estimate from FIG. 10, the elevation 'shoulders' created by the radiation from element 24 are approximately 13 dB down from beam peak (of the main elements 16). The 13 dB comes from the 6+7=13 dB described above. The choice of exciting the NuFSA element 24 with −7 dB from the power split 32 is one option, it could be chosen to be −5 dB or −10 dB, depending on what results in the best pattern. The 6 dB number is set by the number of columns 14 in each main facet 12: in this case it is four columns 14 so the 4:1 ratio is 6 dB. The NuFSA pattern in FIG. 11 looks 4 times wider because of the ratio of four elements 16 vertically in main facet column 14 relative to single element 24 in the NuFSA. It's the same 6+7=13 dB.

The relative excitation of null-filing elements 24 can be changed to other relative levels if needed based on the intended design. For example, the relative excitation of null-filing elements 24 can be changed relative to the levels from element 12 by changing the power split ratio of splitter 32 as a matter of design choice depending on the desired pattern.

Figure 1:
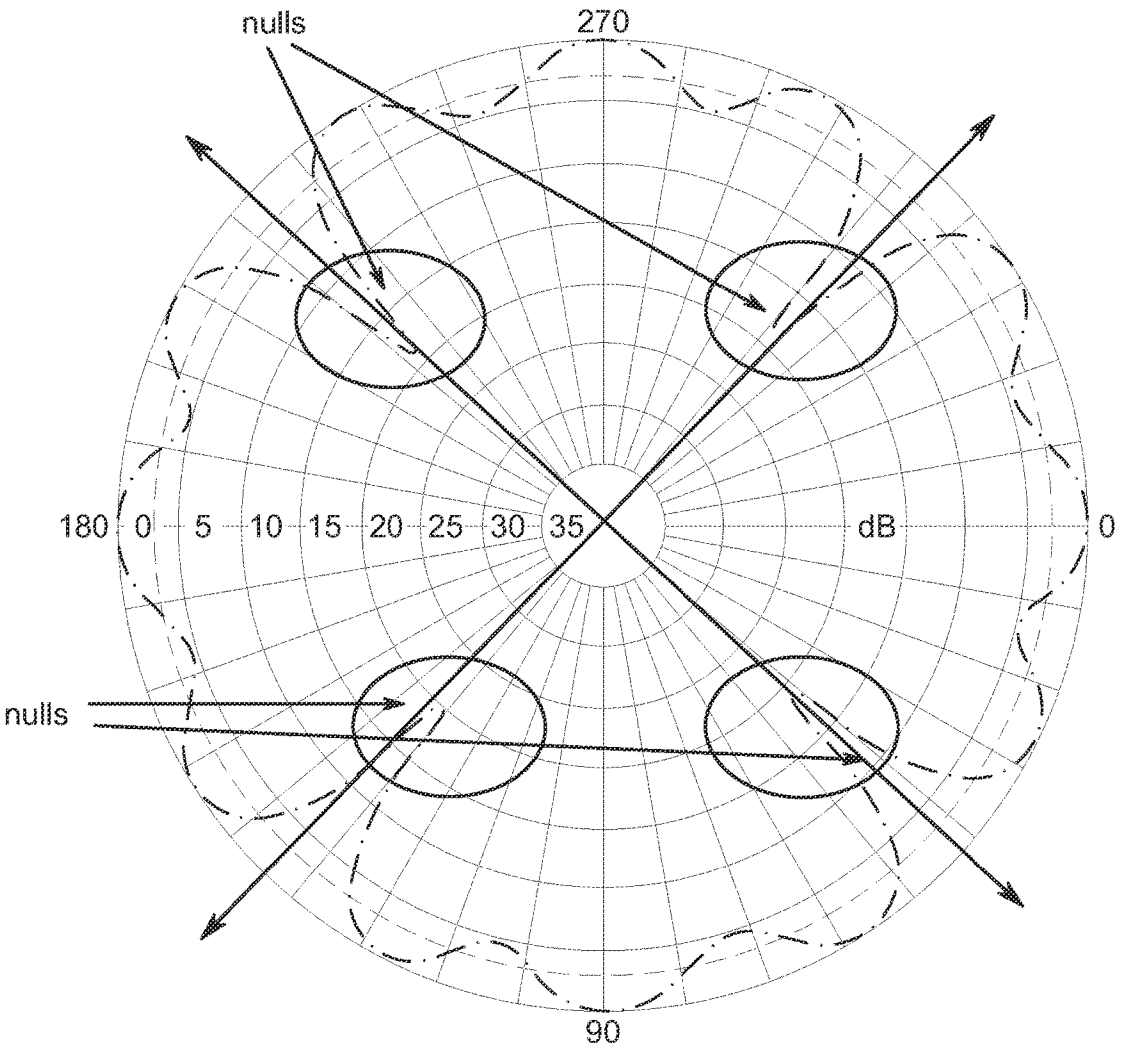
FIG. 1 (PRIOR ART)
FIG. 1 illustrates a prior art azimuth pattern of a quasi-omni antenna with four facets, exhibiting excess nulls in the pattern.
Figure 2A:
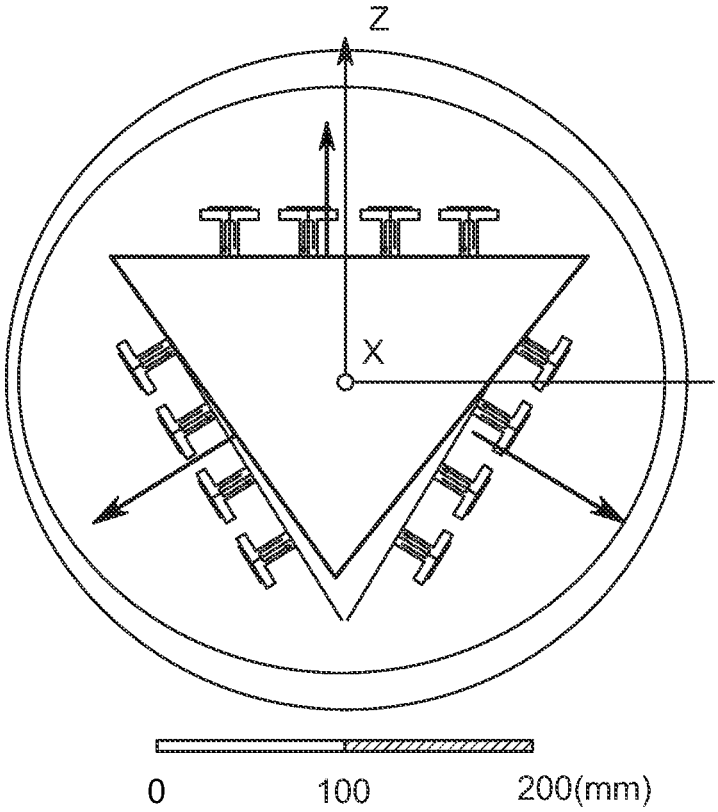
FIG. 2A (PRIOR ART)
FIGS. 2A and 2B show a prior art three facet antenna and its azimuth pattern, also exhibiting deep nulls corresponding to the intersections of the three facets.
Figures 2B, 2C:
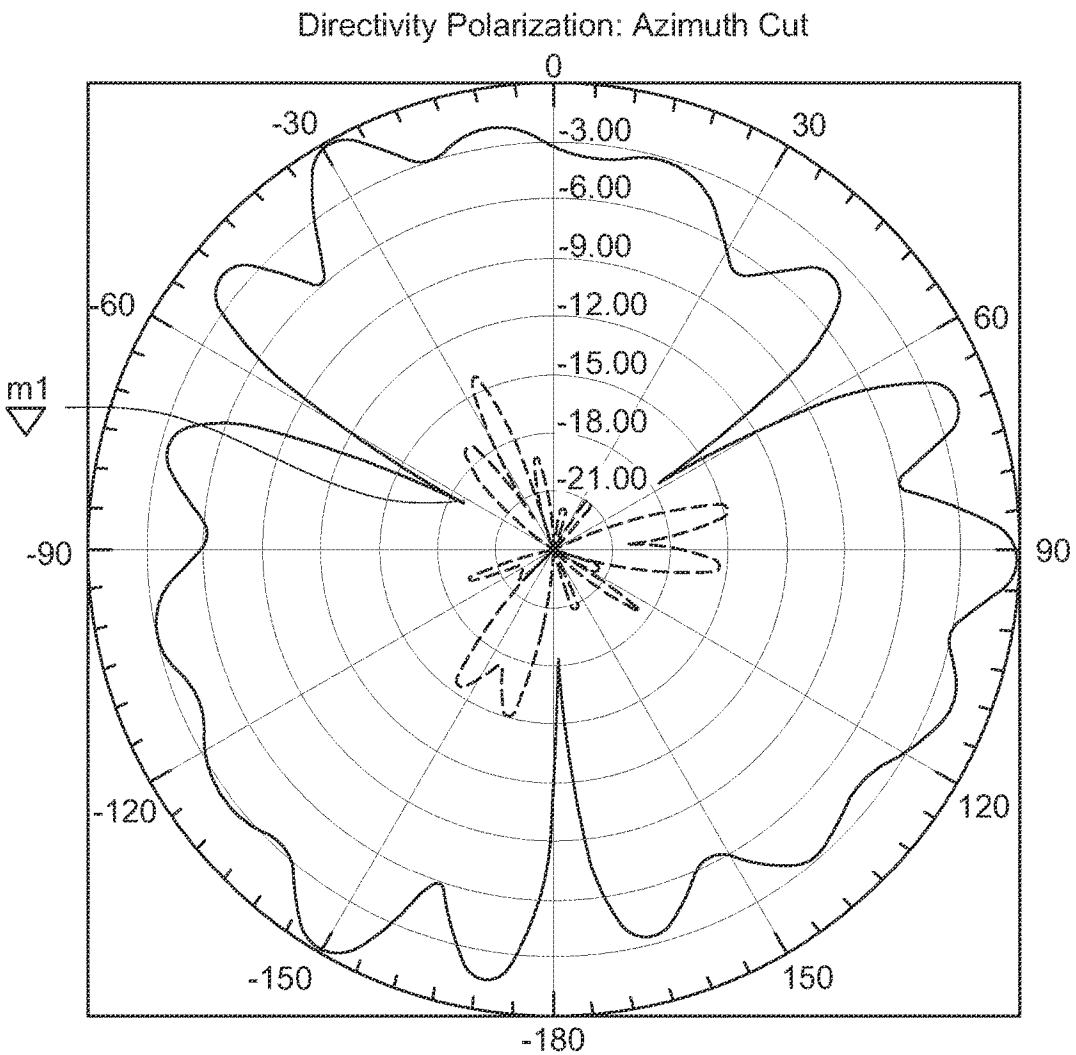
FIG. 2B (PRIOR ART)
FIG. 2C (PRIOR ART)
FIG. 2C is a table identifying the frequency as well as a point M1 as well as the Theta, Ang, and Mag (magnitude) from the azimuth pattern in FIG. 2B.
Figure 3A:
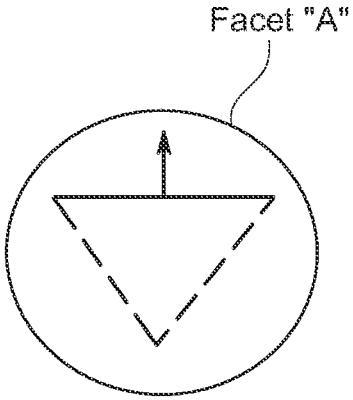
FIG. 3A (PRIOR ART)
Figure 3B:
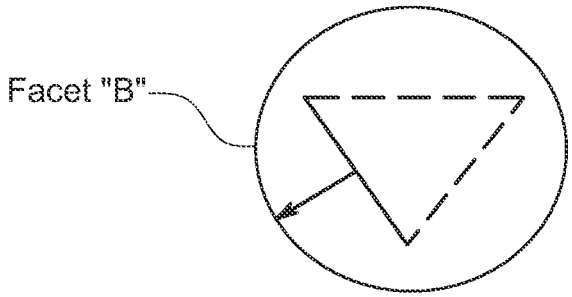
FIG. 3B (PRIOR ART)
Figure 3C:
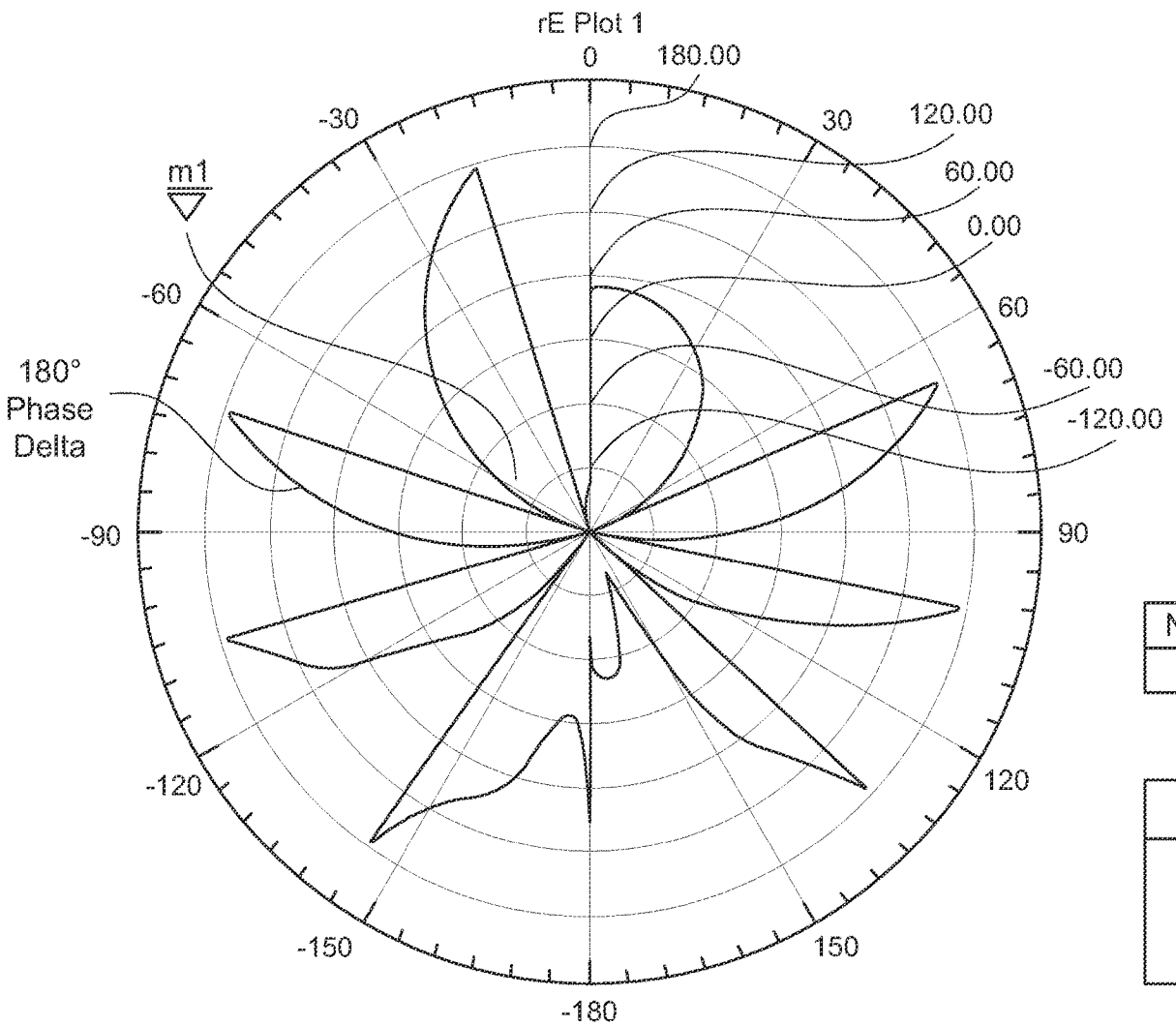
FIG. 3C (PRIOR ART)
Figure 3D:
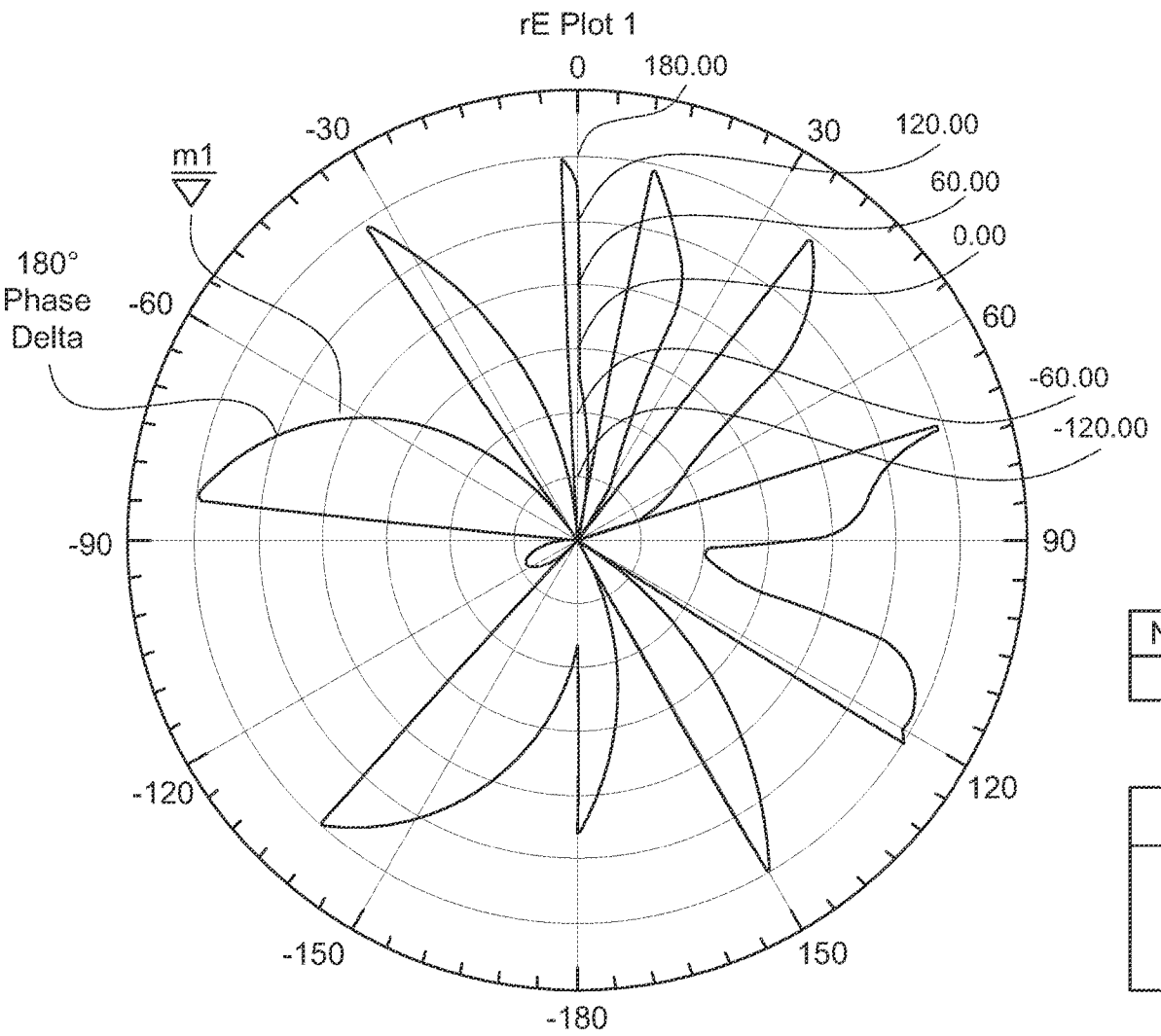
FIG. 3D (PRIOR ART)
Figure 4A:
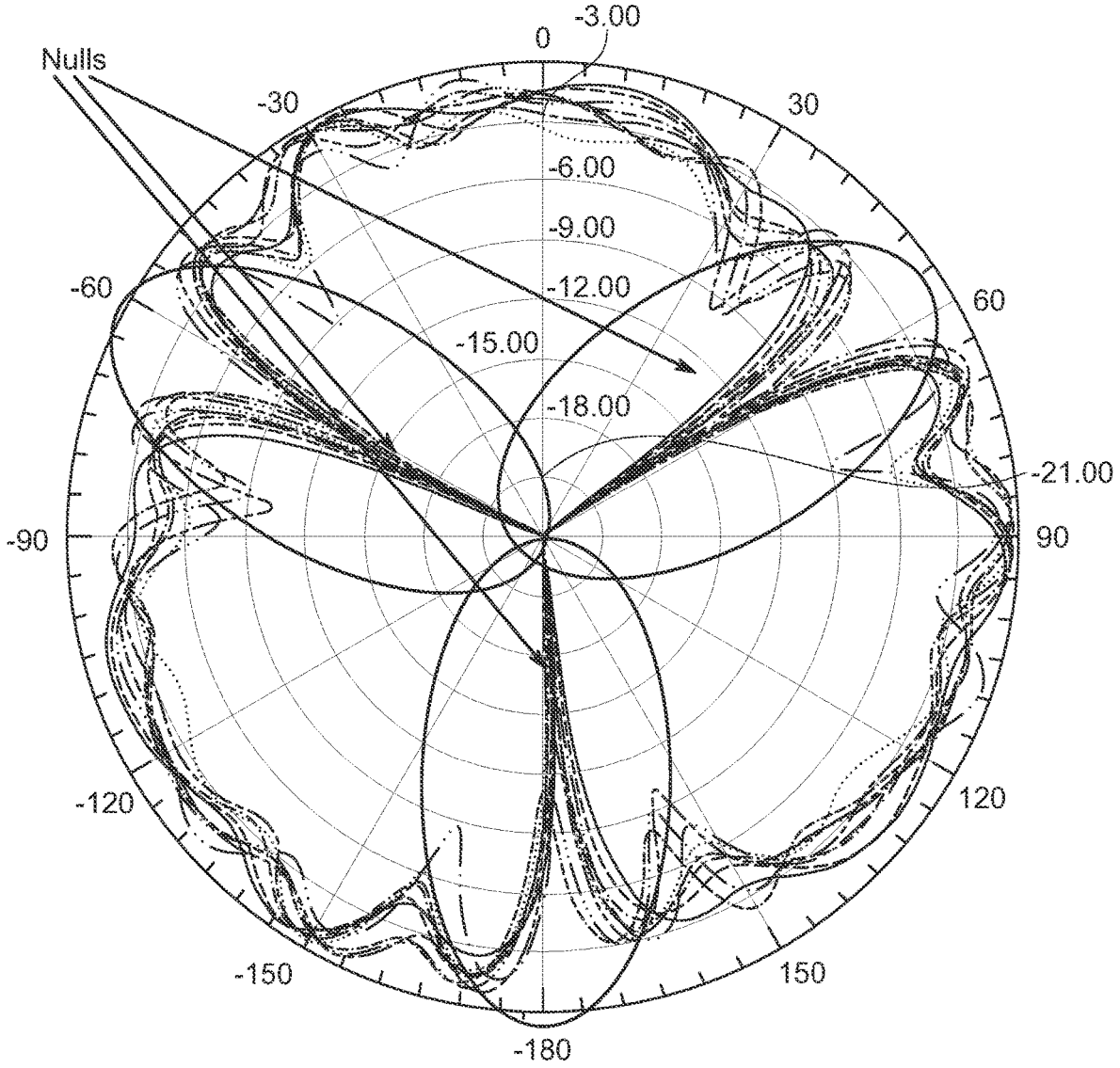
FIG. 4A (PRIOR ART)
Figure 5A:
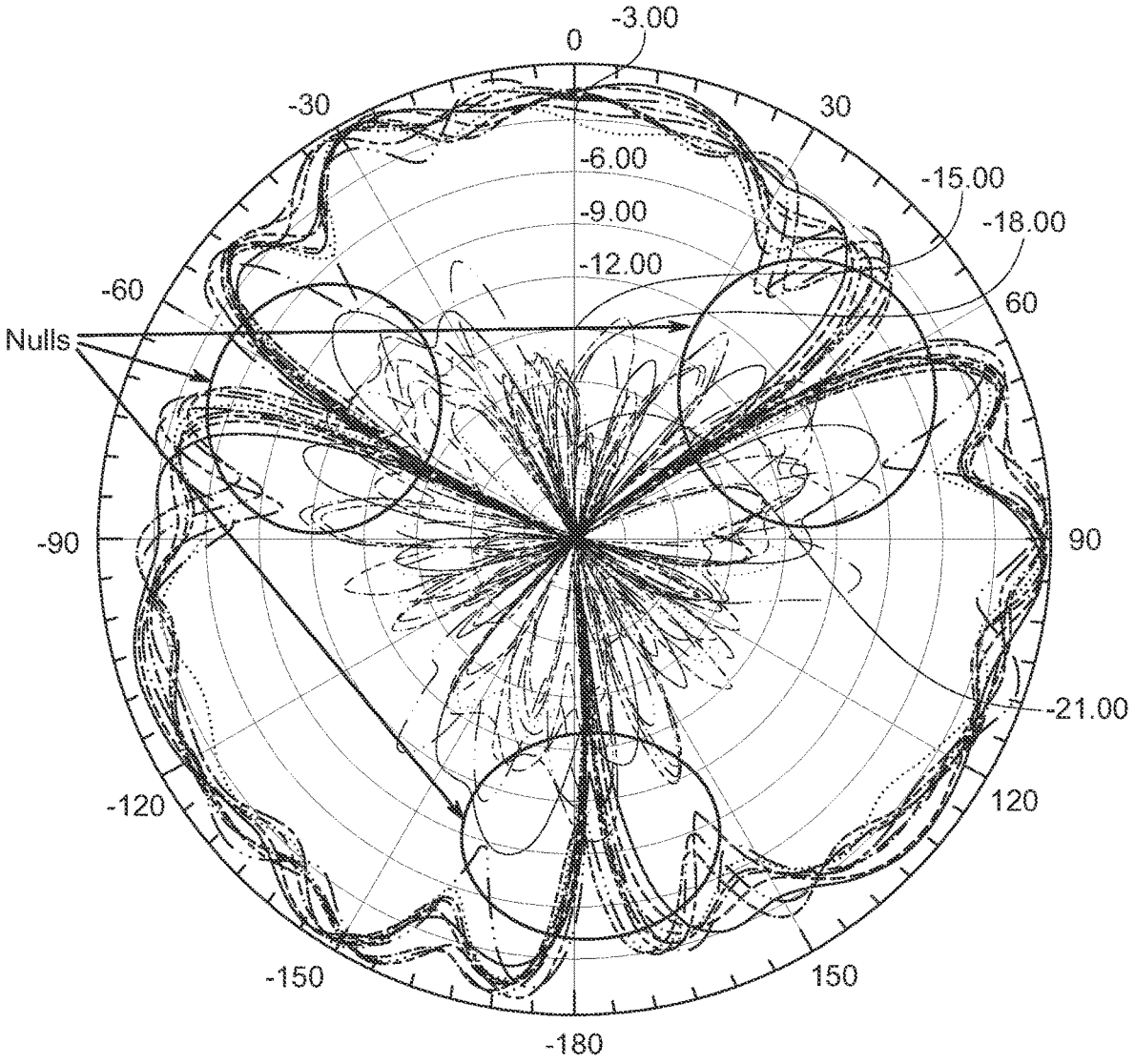
FIG. 5A (PRIOR ART)

Regarding the issue of polarization, we return to the prior art FIG. 5A which shows an azimuth pattern with both co-pole and cross-pole azimuth patterns of a prior art three panel quasi omni antenna. In FIG. 5A as described above, near the pattern null, but across a fairly wide-angle range, cross pole radiated content increases and even rises above the radiated co-pole content. Thus, it becomes clear that there are performance consequences when using different polarity for main facets 12 versus the null filling facets 20 because different polarizations between the two would mostly remove the risk of anti-phase deep nulls and the resultant loss of polarization purity would not be so different from the loss of polarization purity in the case of prior art non-NuFSA implementation compared to the present NuFSA implementation (shown in FIGS. 7A and 7B). Applicants note that, although exciting in NuFSA element 24 a polarization other than the main facet 12 co-polarity results in higher content of 'undesired' polarization, the cross-pole discrimination is so degraded in the azimuth null region that this small cross-pole contribution from NuFSA element 24 is not seen as significant. This effect is further mitigated by the lower NuFSA element 24 excitation level, relative to the main facet column 14.

To this end, FIG. 12A-12C shows a chart of four different polarization configurations 1*a*, 1*b*, 2*a*, and 2*d*. In configuration 1*a*, when elements 16 of main facet 12 are fed with +45° polarization, null filling elements 24 on null filling panels 20 are likewise fed with the same +45° polarization. The same is true when main panel elements 16 are fed with −45° polarization, with null filling elements 24 on null filling panels 20 are likewise fed with −45° polarization.

In configuration 1*b*, when elements 16 of main facet 12 are fed with +45° polarization, null filling elements 24 on null filling panels 20 are likewise fed with the opposite −45° polarization.

In configurations 2*a* and 2*b* when elements 16 of main facet 12 are fed with +45° polarization, null filling elements 24 on null filling panels 20 are fed with either right-hand circular polarization or left-hand circular polarization (respectively). Circular polarization is created with a dual linear polarized element by exciting the two linear polarizations 90 degrees out of phase with each other. For example FIG. 12*c* achieves that with RHCP "in" is one input and results in a 0/90 relative output. The LHCP "in" input results in a 0/−90 relative output. So those 2 inputs create the two orthogonal circular polarizations.

FIG. 12B shows the basic linear polarization examples on an exemplary dipole element. FIG. 12C shows the arrangement for the RH or LH circular polarization being passed through a 90° hybrid coupler 50.

Figure 6A:
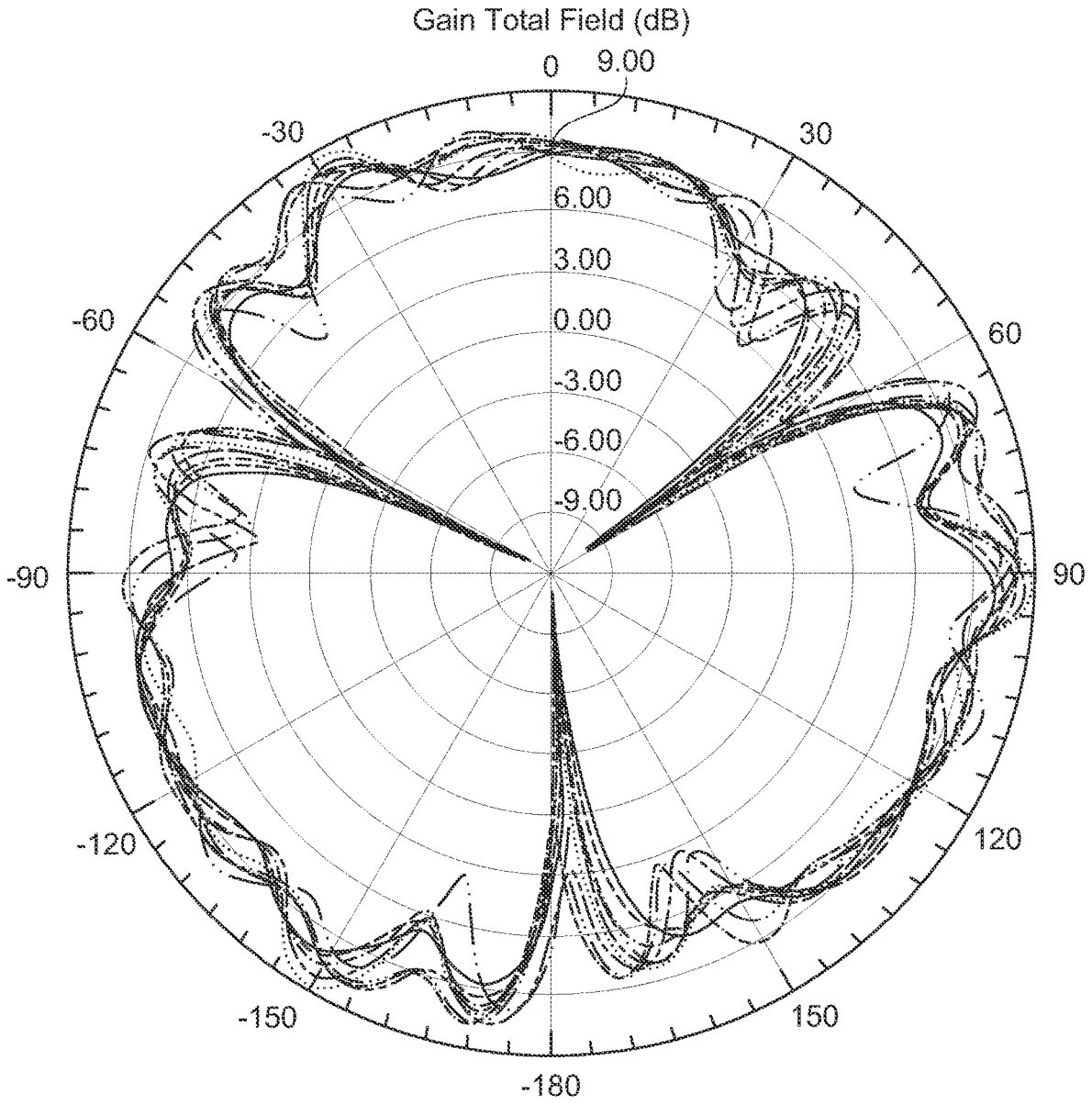
FIG. 6A (PRIOR ART)

The following figures compare total field gain plots co/cross pole azimuth patterns between prior art three panel quasi omni antennas (e.g. FIGS. 5A and 6A) and total field gain plots co/cross pole azimuth pattern of a three panel NuFSA antenna 10 (from FIGS. 7A and 7B), in the different polarization configurations outlined in FIG. 12.

Figure 13A:
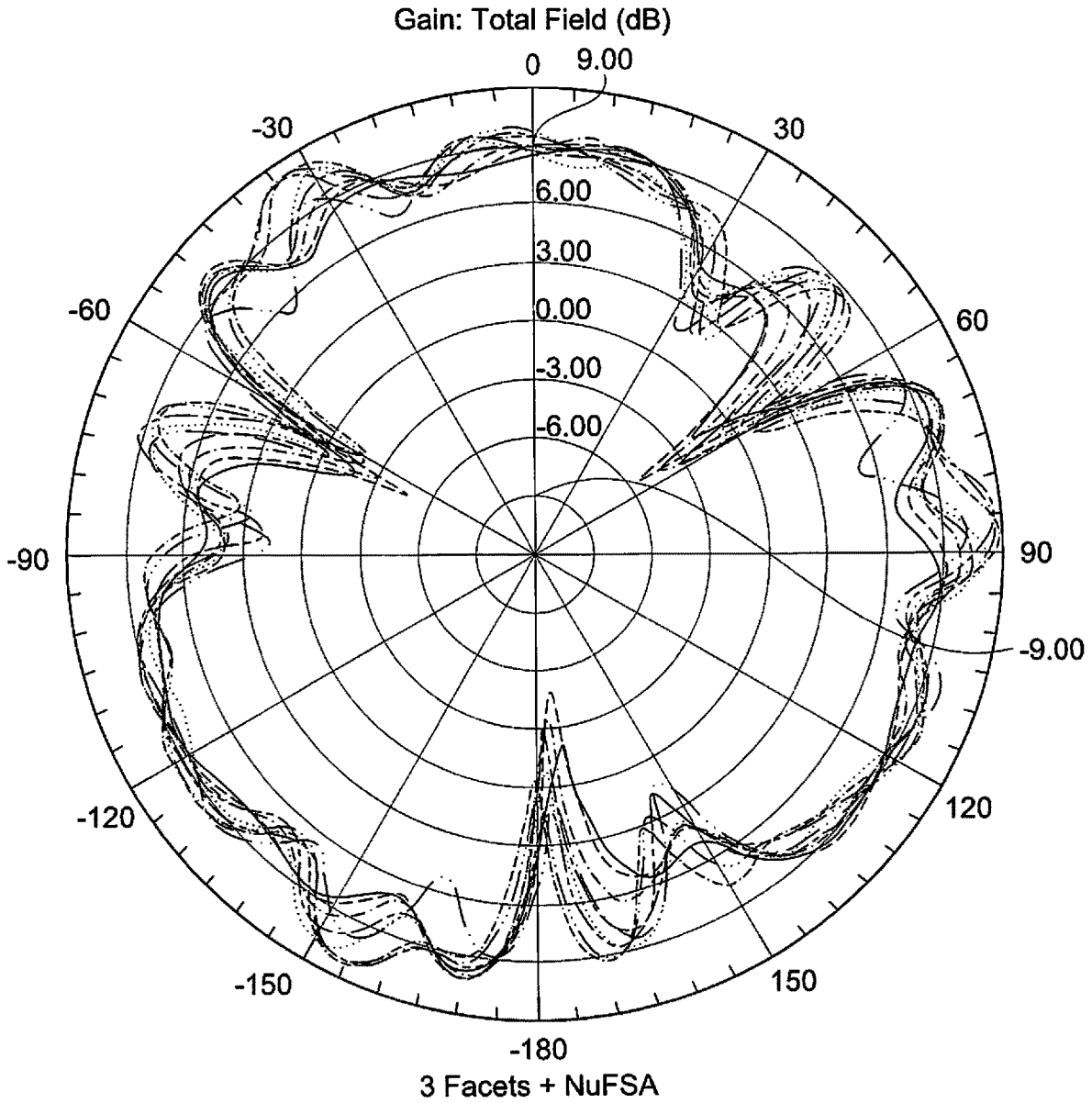

For example, FIG. 13A compares the prior art total field gain of the prior art three panel quasi omni antennas (from FIG. 6A) versus the total field gain of a three panel NuFSA antenna 10 (e.g. FIGS. 7A and 7B), where antenna 10 on the right is using the configuration 1*a* for the polarity of the elements (same between main panel 12 and null panels 20). As shown in FIG. 13A, the nulls in the pattern are clearly mitigated in the pattern on the right relating to the present arrangement. Table 13B explains the various testing frequencies used in the sweep pattern for generating the patterns shown in FIG. 13A (i.e. ranging between 3.1 Ghz and 4.2 Ghz).

Figure 14A:
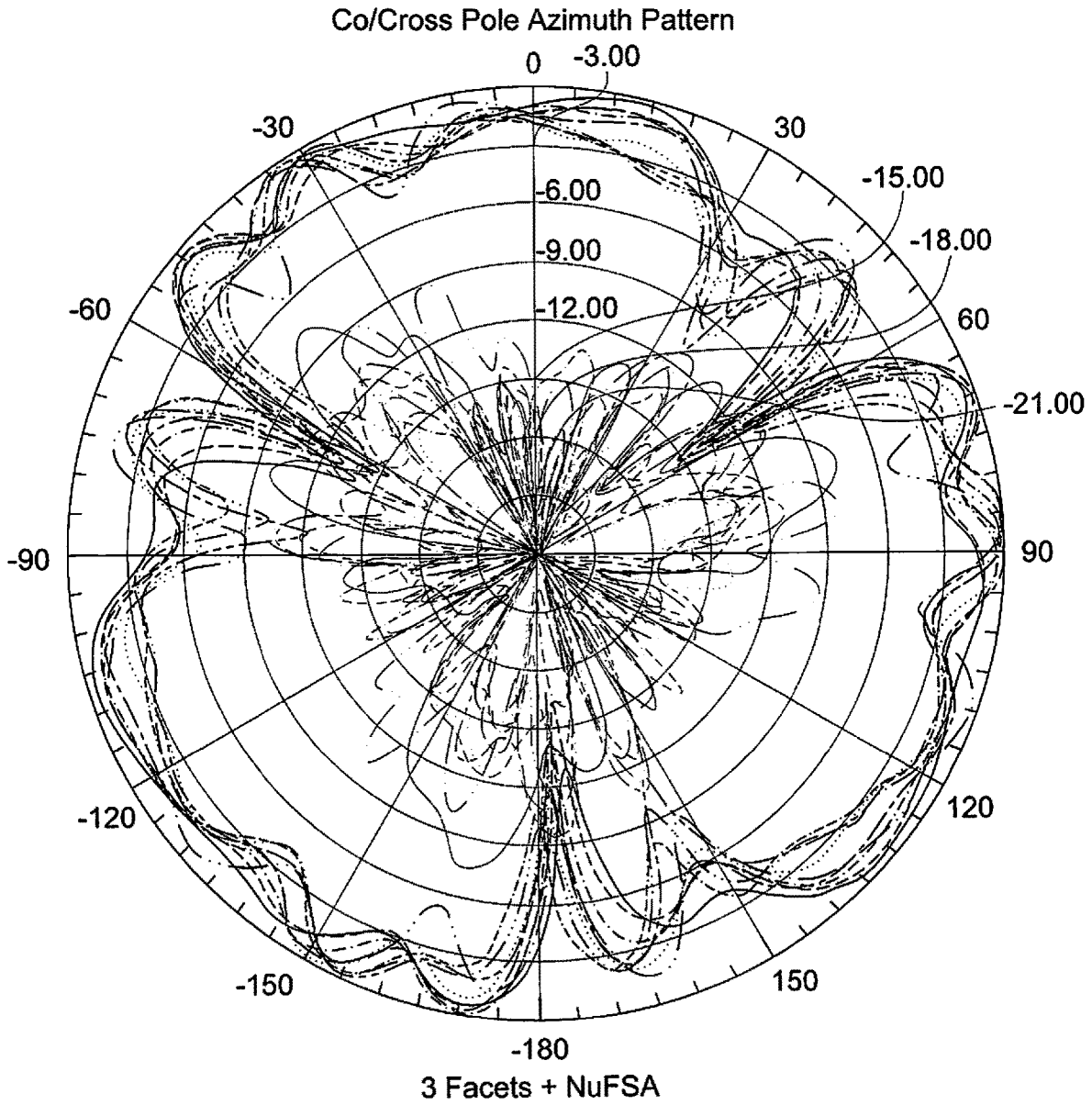

FIG. 14A compares the prior art co/cross pole azimuth pattern of the prior art three panel quasi omni antennas (from FIG. 5A) versus the co/cross pole azimuth pattern of a three panel NuFSA antenna 10 (e.g. FIGS. 7A and 7B), where, again, antenna 10 on the right is using the configuration 1*a* for the polarity of the elements (same between main panel 12 and null panels 20). Table 14B mirrors FIG. 13B showing the various testing frequencies used in the sweep pattern for generating the patterns shown in FIG. 14A (ranging between 3.1 Ghz and 4.2 Ghz). Applicants note that 1*a* configuration of polarization (same for main facet elements 16 as for NuFSA element 24) is sensitive to the relative excitation phase of NuFSA element 24. It is susceptible to inadvertently creating more nulls in the azimuth pattern due to the anti-phasing cancellation mentioned earlier, but this can be overcome by careful choice of the excitation phasing.

Figure 15A:
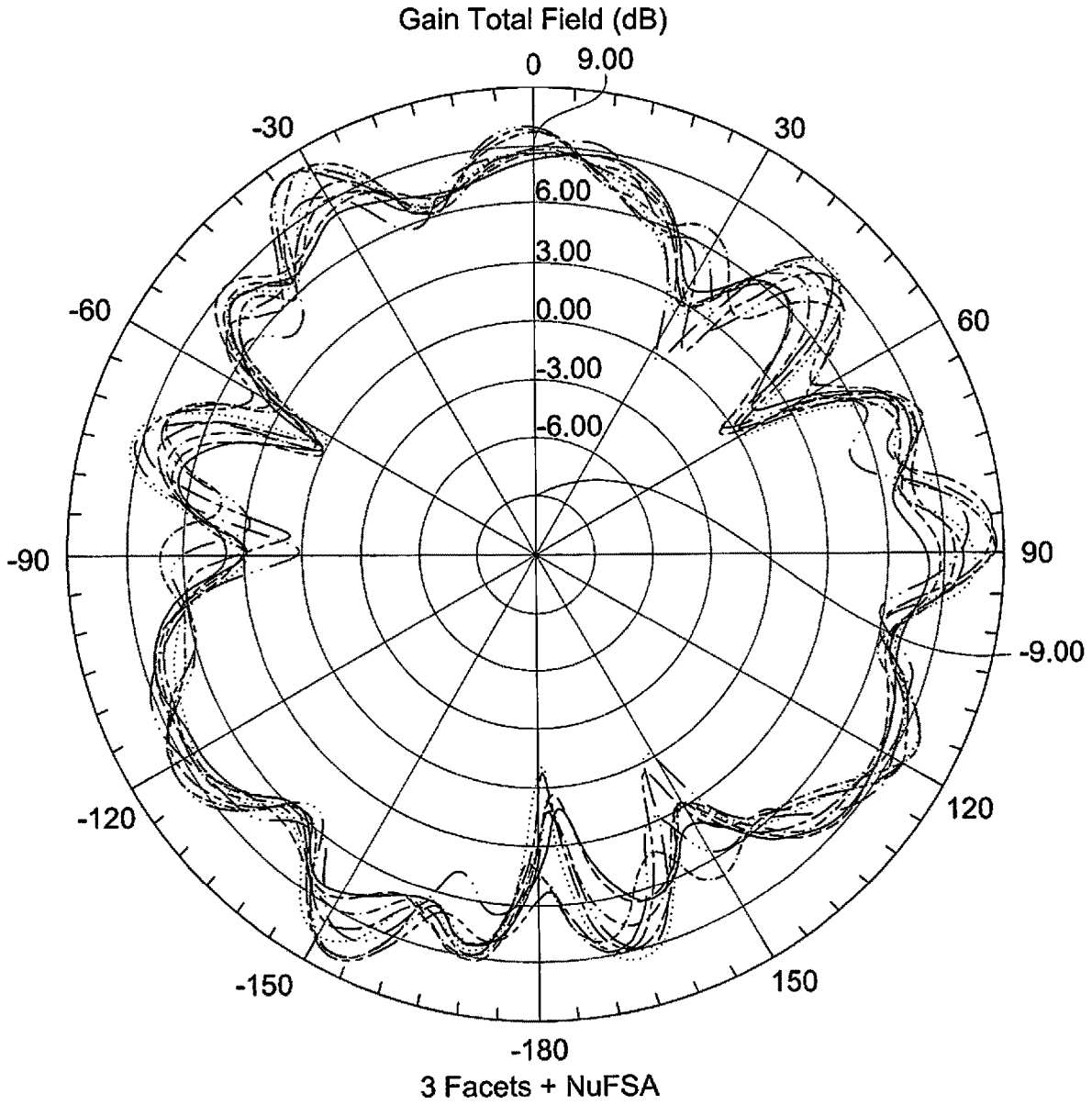

FIG. 15A compares the prior art total field gain of the prior art three panel quasi omni antennas (from FIG. 6A) versus the total field gain of a three panel NuFSA antenna 10 (e.g. FIGS. 7A and 7B), where antenna 10 on the right is using the configuration 2*a*/2*b* for the polarity of the elements (main panel 12 at +/−45° and null panels 20 at Left or Right circular polarization). Similar to FIG. 13A, FIG. 15A shows that the nulls in the pattern are clearly mitigated in the pattern on the right relating to the present arrangement. Table 15B explains the various testing frequencies used in the sweep pattern for generating the patterns shown in FIG. 15A (i.e. ranging between 3.1 Ghz and 4.2 Ghz).

Figure 16A:
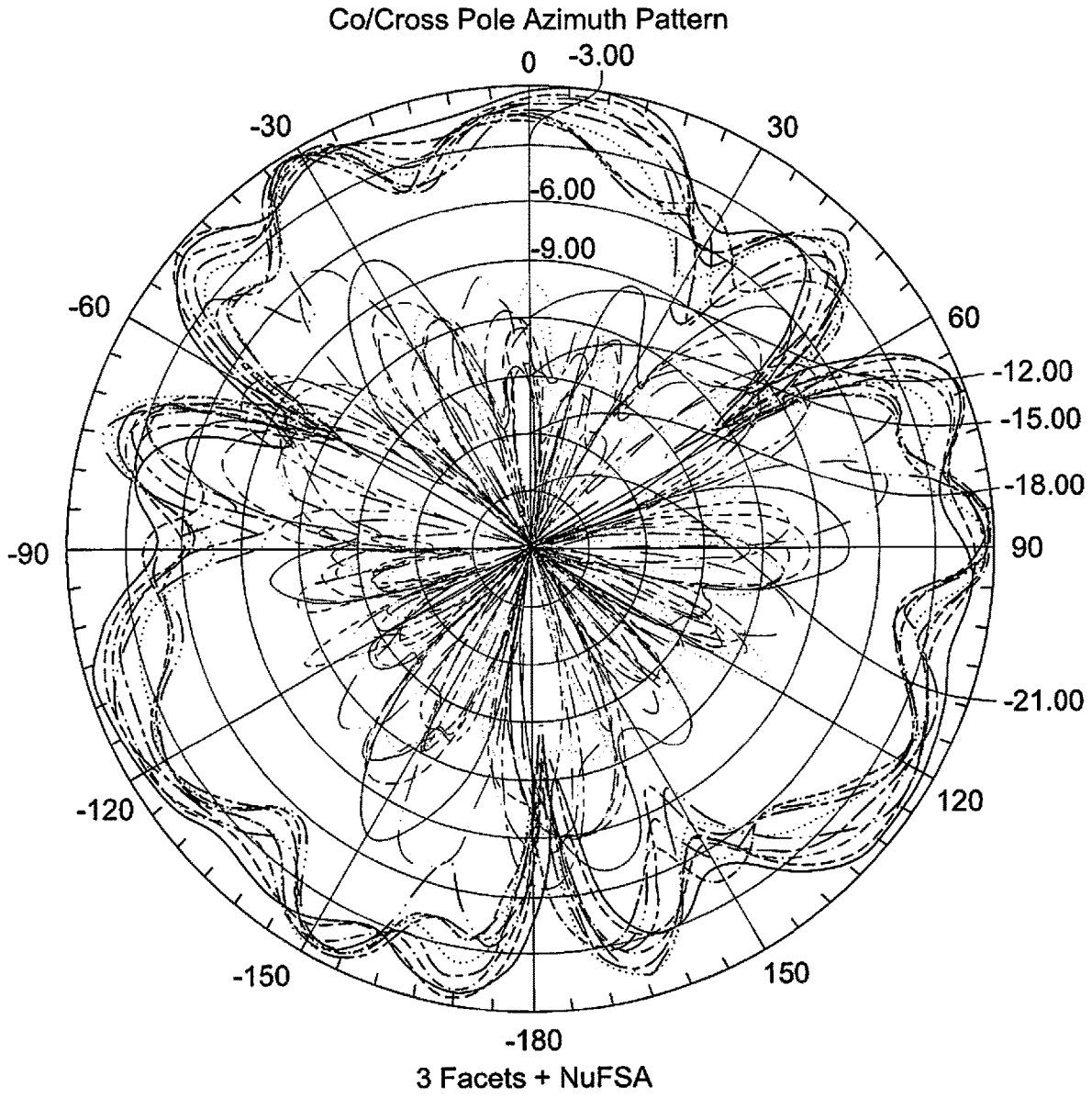

FIG. 16A compares the prior art co/cross pole azimuth pattern of the prior art three panel quasi omni antennas (from FIG. 5A) versus the co/cross pole azimuth pattern of a three panel NuFSA antenna 10 (e.g. FIGS. 7A and 7B), where, again, antenna 10 on the right is using the configuration 2*a*/2*b* for the polarity of the elements (main panel 12 at +/−45° and null panels 20 at Left or Right circular polarization). Table 16B mirrors FIG. 15B showing the various testing frequencies used in the sweep pattern for generating the patterns shown in FIG. 16A (ranging between 3.1 Ghz and 4.2 Ghz). Applicants note that overall the configurations 2*a* and 2*b* appear to be useful in the total field gain plots and improve null depth issues.

Figure 17A:
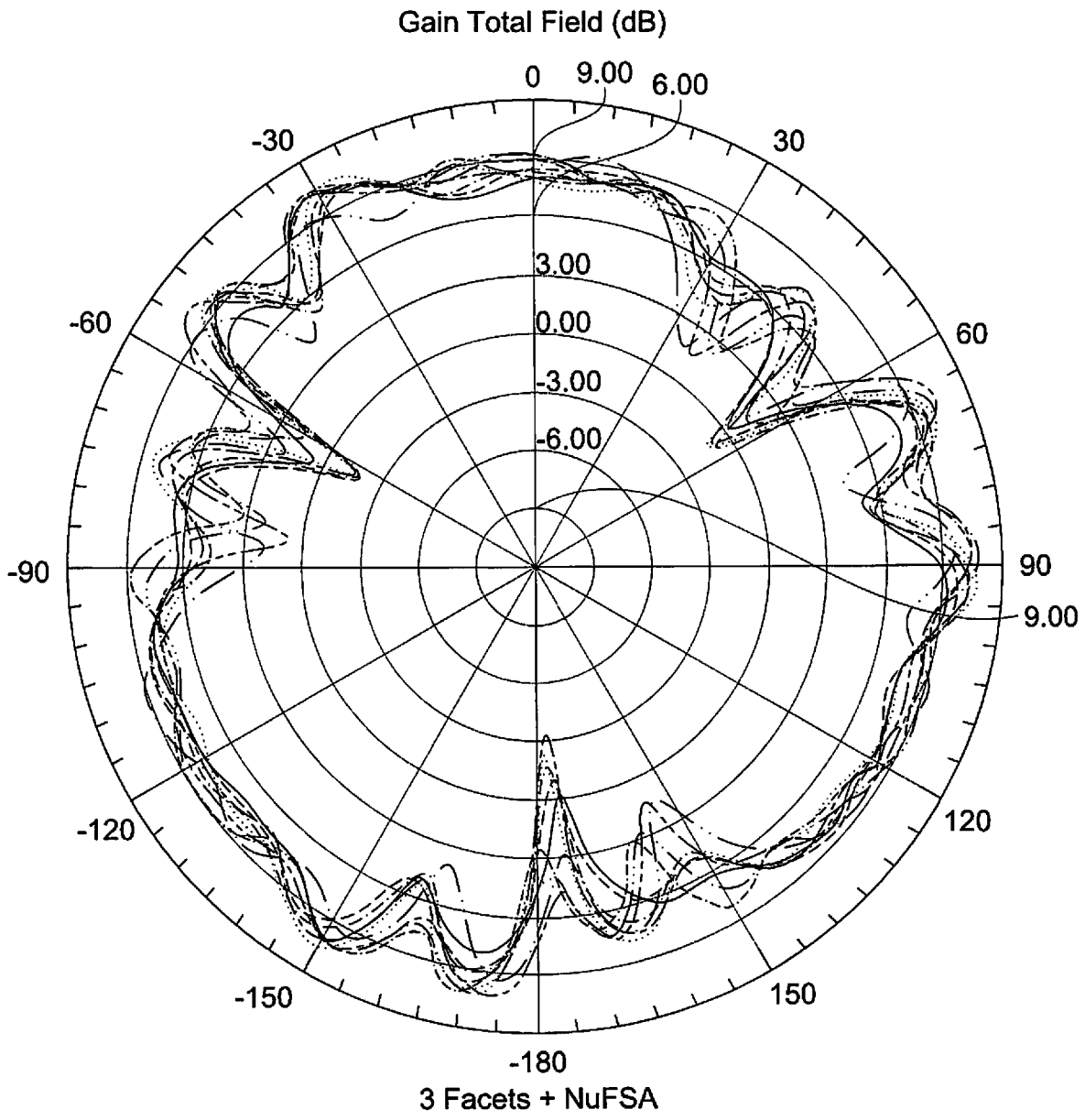

FIG. 17A compares the prior art total field gain of the prior art three panel quasi omni antennas (from FIG. 6A) versus the total field gain of a three panel NuFSA antenna 10 (e.g. FIGS. 7A and 7B), where antenna 10 on the right is using the configuration 1*b* for the polarity of the elements (opposite polarity between main panel 12 and null panels 20). Similar to FIGS. 13A and 15A, FIG. 17A shows that the nulls in the pattern are clearly mitigated in the pattern on the right relating to the present arrangement. Table 17B explains the various testing frequencies used in the sweep pattern for generating the patterns shown in FIG. 17A (i.e. ranging between 3.1 Ghz and 4.2 Ghz).

Figure 18A:
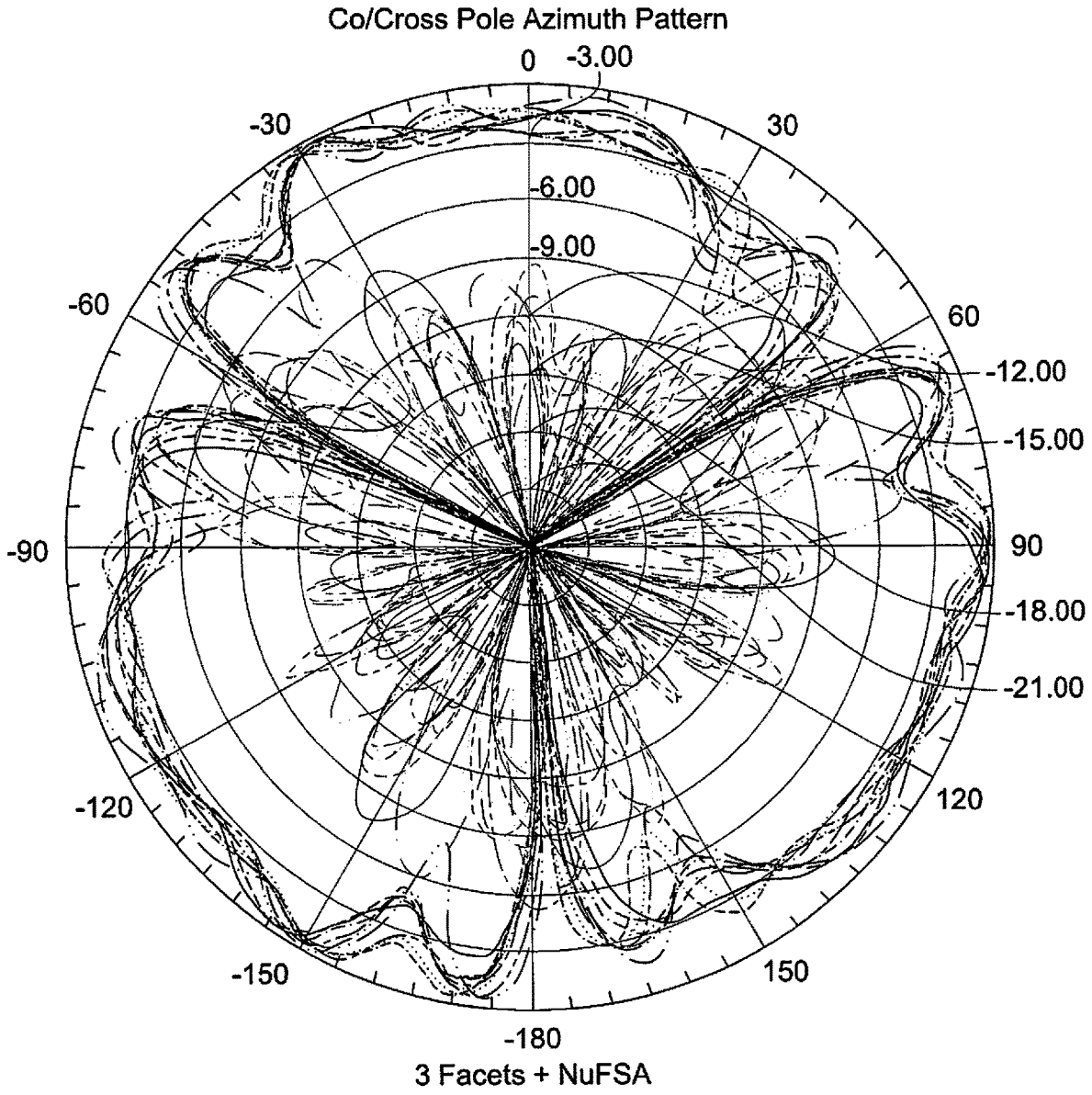

FIG. 18A compares the prior art co/cross pole azimuth pattern of the prior art three panel quasi omni antennas (from FIG. 5A) versus the co/cross pole azimuth pattern of a three panel NuFSA antenna 10 (e.g. FIGS. 7A and 7B), where, again, antenna 10 on the right is using the configuration 1*b* for the polarity of the elements (opposite polarity between main panel 12 and null panels 20). Table 18B mirrors FIG. 17B showing the various testing frequencies used in the sweep pattern for generating the patterns shown in FIG. 18A (ranging between 3.1 Ghz and 4.2 Ghz). Applicants note that this polarity arrangement may be used to show improvement on the total field gain plot.

As illustrated in FIGS. 13A, 15A, and 17A, antenna 10, improves the total gain in the null areas over the prior art. However, FIGS. 14A, 16A, and 18A show that there are slight variations in the trade-off between the coverage null depth and the cross-polarization radiation level depending on the polarization configurations used from FIG. 12.

For example, using circular polarity for elements 24 on null filling panels 20 provides the best absolute coverage, but with degraded cross polarization levels (See e.g. FIG. 16A). Applicants note that the conventional approach to the multi-facet quasi-omni array also has degraded polarization purity near the pattern null angles, so depending on the relative excitation levels of the null filling panels 20 in antenna 10, it may not be an issue. This implementation is relatively insensitive to the relative phase of excitation of the NuFSAsub arrays. However, the co-pole implementations of configurations 1*a* or 1*b* for elements 24 of null filling panels 20 show that they are sensitive to the relative phase of excitation of the null filling panels 20 in antenna 10 (See e.g. FIGS. 14A and 18A), although this can be overcome with careful design when setting the NuFSA element 24 relative excitation phase.

Thus, the present arrangement provides an antenna 10 that includes null filling panels 20 in addition to main panels 12 that radiate towards the angular location where main facets 12 radiation nulls, 'filling' the nulls with signal strength so the overall azimuth pattern and total field gain has reduced null depth, compared to a conventional quasi-omni array.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An antenna for producing a quasi-omni radiation pattern, said antenna comprising:

at least three main panels, each having a plurality of radiating elements thereon, disposed in one or more columns of elements;

said main panels disposed in a substantially circular arrangement to generate said quasi-omni radiation pattern; and at least one null filling panel disposed between every two consecutive main panels of said at least three main panels, said null filling panels having at least one element for every column of elements on said adjacent main panel, said null filling panel directed towards a null in said quasi-omni radiation pattern between said two consecutive main panels;

wherein said elements of said null filling panels have elements that radiate a null filling pattern that is substantially based on an excitation signal input for elements from an adjacent one of said main panels, wherein for each element of said null filling panels, said excitation signal input feeding said element is a lesser partial excitation signal split from excitation signal input for a column of elements from an adjacent main panel.

2. The antenna as claimed in claim 1, wherein said antenna has three main panels, each having a plurality of columns of elements.

3. The antenna as claimed in claim 2, wherein said three main panels are arranged at substantially 120° intervals in said substantially circular arrangement.

4. The antenna as claimed in claim 3, wherein said antenna has three null filling panels, one disposed between each of said three main panels, located at a 60° offset relative to an adjacent main panel.

5. The antenna as claimed in claim 4, wherein said three main panels each have four columns of elements, and said three null filling panels each have one column of elements.

6. The antenna as claimed in claim 5, wherein each of said column of elements on both said main panels and said null filling panels have four elements, and wherein an excitation signal for one of said four columns on one of said main panels, is split and fed to a single element in the column of elements on said null filling panel.

7. The antenna as claimed in claim 6, wherein said signal fed to said single element in the column of elements on said null filling panel is at a power about 1/20-1/40 of the power to said excitation signal for one of said four columns of one of said main panels.

8. The antenna as claimed in claim 7, wherein a pattern from null-filling elements is approximately four times wider than an elevation beam from said main facet elements.

9. The antenna as claimed in claim 8, wherein shoulders of said pattern from null filling elements are approximately 13 dB down from a beam peak of said an elevation beam from said main facet elements.

10. The antenna as claimed in claim 1, wherein a polarization of said elements on said main panel are fed with +45° polarization and wherein a polarization of said elements on said null filing panel are fed with a +45° polarization.

11. The antenna as claimed in claim 1, wherein a polarization of said elements on said main panel are fed with +45° polarization and wherein a polarization of said elements on said null filing panel are fed with an opposite −45° polarization.

12. The antenna as claimed in claim 1, wherein a polarization of said elements on said main panel are fed with +45° polarization and wherein a polarization of said elements on said null filing panel are fed with a RHCP Right Handed Circular Polarization.

13. The antenna as claimed in claim 1, wherein a polarization of said elements on said main panel are fed with +45° polarization and wherein a polarization of said elements on said null filing panel are fed with a LHCP Left Handed Circular Polarization.

* * * * *